US008059052B2

(12) United States Patent
Kanno

(10) Patent No.: US 8,059,052 B2
(45) Date of Patent: Nov. 15, 2011

(54) ENDFIRE ANTENNA APPARATUS WITH MULTILAYER LOADING STRUCTURES

(75) Inventor: Hiroshi Kanno, Osaka (JP)

(73) Assignee: Panasonic Corporation, Osaka (JP)

( * ) Notice: Subject to any disclaimer, the term of this patent is extended or adjusted under 35 U.S.C. 154(b) by 409 days.

(21) Appl. No.: 12/361,737

(22) Filed: Jan. 29, 2009

(65) Prior Publication Data

US 2009/0195460 A1 Aug. 6, 2009

(30) Foreign Application Priority Data

Feb. 1, 2008 (JP) ..... 2008-022870

(51) Int. Cl.
*H01Q 13/00* (2006.01)

(52) U.S. Cl. ..... 343/785; 343/700 MS; 343/895; 343/767

(58) Field of Classification Search ..... 343/700 MS, 343/702, 895, 767, 786, 770, 771; 333/33, 333/238, 26, 116, 246, 202, 206, 204, 161, 333/128

See application file for complete search history.

(56) References Cited

U.S. PATENT DOCUMENTS 6,489,930 B2 12/2002 Teshirogi et al.
2003/0142036 A1 * 7/2003 Wilhelm et al. ..... 343/909

FOREIGN PATENT DOCUMENTS

JP 49-11445 1/1974
JP 2001-320229 11/2001
JP 2002-237716 8/2002
JP 2003-158420 5/2003
JP 2003158421 A * 5/2003
JP 2006-166404 6/2006

OTHER PUBLICATIONS

T. Teshirogi, et al. "High-Efficiency, Dielectric Slab Leaky-Wave Antennas", IEICE Transactions on Communications, Institute of Electronics, Information and Communication Engineers (IEICE), vol. E84-B, No. 9, pp. 2387-2394. Sep. 2001.

R. J. Mailloux, "Antenna and wave theories of infinite yagi-uda arrays", IEEE Transactions on Antennas and Propagation, vol. 13, No. 4, Jul. 1965, pp. 499-506.

Hung-Yu David Yang et al., "Theory of Line-Source Radiation from a Metal-Strip Grating Dielectric-Slab Structure", IEEE Transactions on Antennas and Propagation, vol. 48, No. 4, Apr. 2000, pp. 556-564.

* cited by examiner

*Primary Examiner* — Douglas W Owens
*Assistant Examiner* — Jae Kim
(74) *Attorney, Agent, or Firm* — Wenderoth, Lind & Ponack, L.L.P.

(57) ABSTRACT

A plurality of conductive strip elements compose multilayer loading structures on top and bottom surfaces of a dielectric transmission substrate, by which a part of intra-substrate transmission components of a electromagnetic wave are leaked out of the surfaces. Each multilayer loading structure includes a first conductive strip group of conductive strip elements within a first plane, and a second conductive strip group of conductive strip elements within a second plane, and the first and second conductive strip groups are formed to be capacitively coupled to each other. In each of the first and second conductive strip groups, the conductive strip elements are placed at intervals of a distance of a quarter or less of a reference adjacent distance, where the reference adjacent distance is defined as a distance for generating spatial harmonics of the electromagnetic wave on the surfaces of the dielectric transmission substrate.

8 Claims, 15 Drawing Sheets

ENDFIRE ANTENNA APPARATUS WITH MULTILAYER LOADING STRUCTURES

BACKGROUND OF THE INVENTION

1. Field of the Invention

The present invention relates to an antenna for transmitting and receiving analog or digital radio frequency signals in a frequency band of the microwave band or higher, mainly in a frequency band of the millimeter-wave band. More particularly, the present invention relates to an endfire antenna apparatus, efficiently radiating in a direction parallel to a substrate that is provided with a plurality of conductive elements composing the antenna.

2. Description of the Related Art

In recent years, it has been considered to adopt millimeter-wave radio techniques not only to an onboard radar for cars, but also to a wireless LAN (Local Area Network) and a wireless PAN (Personal Area Network). In order to provide a small-sized terminal with a millimeter-wave radio unit, it is essential to reduce the antenna size, i.e., to reduce the thickness of a circuit board including the antenna unit, and to reduce the area of the circuit. Meanwhile, as compared to the case of the microwave band, the propagation loss increases in the case of using the millimeter-wave band, nevertheless, it is difficult to implement a transmission system with high-power output in that case. Thus, as a consequence, an antenna requires high gain characteristics.

As millimeter-wave band antennas for use in onboard radars, high-gain dielectric leaky-wave antennas are known that converts leaky waves on dielectric, transmitted along an interface between the dielectric and air, into radiation components, as disclosed in Patent Documents 1 to 3 and in Non-Patent Document 1. Patent Document 1 discloses a dielectric leaky-wave antenna provided with: a ground plate conductor; a dielectric substrate provided on one side of the ground plate conductor, and forming a transmission path between the ground plate conductor and the dielectric substrate for transmitting an electromagnetic wave along its surface from one end to the other end; loading elements loaded on the dielectric substrate, and for leaking the electromagnetic wave out of the surface of the dielectric substrate; and a feed unit for supplying the electromagnetic wave at the one end of the transmission path formed between the ground plate conductor and the dielectric substrate. The dielectric leaky-wave antenna is characterized in that a dielectric layer with a permittivity lower than that of the dielectric substrate is provided between the ground plate conductor and the dielectric substrate. The loading elements are a plurality of metal strips placed in parallel to each other at intervals of a certain distance "d", and to be orthogonal to a transmission direction of the electromagnetic wave in the transmission path. The loading elements are formed on the front side of the dielectric substrate, which opposite to the side of the dielectric layer. Furthermore, the loading elements convert a part of the electromagnetic wave propagating through the dielectric substrate, into leaky waves on the dielectric.

According to Patent Document 1, in order to leak the leaky waves on the dielectric in a direction of angle $\phi n$ with respect to an axis orthogonal to the dielectric substrate, an adjacent distance "d" of the loading elements must satisfy the following equation:

$$\begin{aligned}\sin(\phi n) &= (\beta/k0) + n(\lambda 0/d) \\ &= (\lambda 0/\lambda g) + n(\lambda 0/d),\end{aligned} \tag{1}$$

where "$\lambda 0$" denotes a free-space wavelength, "$\lambda g$" denotes a guide wavelength inside the dielectric transmission path, "$\beta$" denotes a propagation constant of the dielectric transmission path, "$k0$" denotes a free space propagation constant, and "n" denotes an integer. When discussing radiation components parallel to the dielectric substrate, which is an object of this application and Patent Document 1, the angle "$\phi n$" is 90 degrees. When selecting the adjacent distance "d" of the loading elements by the condition of an endfire radiation including only a radiation wave of n=−1, the adjacent distance "d" of the loading elements satisfies the following equation:

$$\begin{aligned}d &= \lambda 0/[(\lambda 0/\lambda g) - 1] \\ &\cong \lambda 0/\left[\sqrt{\varepsilon_r} - 1\right],\end{aligned} \tag{2}$$

where "$\in_r$" denotes a relative permittivity of the dielectric substrate.

Non-Patent Document 1 discloses an exemplary design of a dielectric leaky-wave antenna that achieves a gain of about 30 dBi with an efficiency of about 60 to 70%, using the technique of Patent Document 1. According to FIG. 5 and Table 3 in Non-Patent Document 1, since a dielectric substrate (aperture) has dimensions of 60×60 mm, and metal strips (loading elements) are placed at intervals of a distance d=1.7 mm, it can be seen that the dielectric leaky-wave antenna of Non-Patent Document 1 has 30 or more metal strips placed periodically.

Additionally, according to Patent Document 1, in order to suppress reflections in the transmission path caused by the loading elements, the dielectric leaky-wave antenna is further provided with another set of metal strips for loading elements (hereinafter, referred to as the second loading elements) so as to make pairs with the respective metal strips for the aforementioned loading elements (hereinafter, referred to as the first loading elements). The metal strips for the second loading elements are placed in parallel to each other at intervals of a adjacent distance "d", and are formed on the side of the dielectric substrate opposite to the side of the first loading elements (i.e., the side facing to the dielectric layer). Further, the metal strips for the second loading elements are displaced by $\lambda g/4$ from the metal strips for the first loading elements, along the transmission direction of the transmission path, where $\lambda g$ denotes the guide wavelength inside the transmission path. Each first loading elements and each second loading elements act as a circuit of a pair of the loading elements to cancel the reflections by each other.

Meanwhile, Patent Document 2 discloses a dielectric leaky-wave antenna is provided with a plurality of leaking metal strips in parallel to each other at intervals of a certain distance, on a front side of a dielectric substrate. Each of the leaking metal strips is composed of two metal strips parallel to each other and spaced apart by about $\lambda g/4$. The leaking metal strips act in the same manner as that of the loading elements in Patent Document 1. Patent Document 3 discloses an example provided with, in addition to the metal strips for the first and second loading elements of Patent Document 1, outgoing metal strips on another wiring layer for rotating the polarization of an electromagnetic wave to be radiated. According to the purpose of the outgoing metal strips, they are oriented at a different angle than that of the metal strips for the first and second loading elements.

(1) Patent Document 1: Japanese Patent Laid-Open Publication No. 2001-320229, (2) Patent Document 2: Japanese Patent Laid-Open Publication No. 2003-158420, (3) Patent Document 3: Japanese Patent Laid-Open Publication No. 2002-237716, and (4) Non-Patent Document 1: T. Teshirogi, et al., "High-efficiency, dielectric slab leaky-wave antennas", IEICE Transactions on Communications, Institute of Electronics, Information and communication Engineers (IEICE), Vol. E84-B, No. 9, pp. 2387-2394, September 2001.

As is apparent from Patent Documents 1 to 3, when the length of a dielectric substrate for generating spatial harmonics and for leaking leaky waves on the dielectric out of its surface (i.e., the length of a region where metal strips for loading elements are placed) cannot be considered to be sufficiently longer than the free-space wavelength $\lambda 0$, the conventional design principles of dielectric leaky-wave antennas cannot be adopted, and thus, it becomes hard to achieve high gain characteristics. Specifically, if determining the adjacent distance "d" of the loading elements so as to satisfy the equation (2) under the condition of short length of the dielectric substrate, then only a small number of loading elements or pairs of loading elements can be placed.

According to Patent Document 1, the dielectric leaky-wave antenna is provided with the loading elements on the front and back sides of the dielectric substrate, at intervals of a distance corresponding to ¼ of the guide wavelength $\lambda g$ inside the transmission path. According to Patent Document 2, the dielectric leaky-wave antenna is provided with the additional loading elements on the front side of the dielectric substrate, spaced apart by the distance corresponding to $\lambda g/4$. However, these loading elements are not added for the purpose of increasing gain, as clearly mentioned in Patent Documents 1 and 2. According to Patent Document 3, although a metal strip structure on a third layer is newly introduced, this structure is not intended to increase gain, either.

SUMMARY OF THE INVENTION

As described above, it is difficult to adopt conventional antenna design techniques under the condition of a reduced length of a dielectric substrate, and thus, there is a limit to obtaining a high gain. Therefore, an object of the present invention is to overcome this problem, and to provide a small endfire antenna apparatus capable of achieving high gain characteristics even under the condition of a reduced length of a dielectric substrate.

According an aspect of the present invention, an endfire antenna apparatus is provided, including a dielectric transmission substrate, and a plurality of conductive strip elements provided to the dielectric transmission substrate so as to be orthogonal to a transmission direction parallel to the dielectric transmission substrate, the endfire antenna apparatus transmitting intra-substrate transmission components of an electromagnetic wave inside the dielectric transmission substrate along the transmission direction, transmitting surface transmission components of the electromagnetic wave along a surface of the dielectric transmission substrate along the transmission direction, and radiating a combined electromagnetic wave of the intra-substrate transmission components and the surface transmission components of the electromagnetic wave at an end of the dielectric transmission substrate. The plurality of conductive strip elements compose a multilayer loading structure on at least one side of the dielectric transmission substrate, by which a part of the intra-substrate transmission components of the electromagnetic wave are leaked out of the surface of the dielectric transmission substrate, as the surface transmission components. The multilayer loading structure includes a first conductive strip group of conductive strip elements provided within a first plane, and a second conductive strip group of conductive strip elements provided within a second plane apart from the first plane by a predetermined distance; and the conductive strip elements of the first conductive strip group and the conductive strip elements of the second conductive strip group are formed to be capacitively coupled to each other. In each of the first and second conductive strip groups, at least a part of the conductive strip elements are placed at intervals of a distance of a quarter or less of a reference adjacent distance, the reference adjacent distance defined as a distance for generating spatial harmonics of the electromagnetic wave on the surface of the dielectric transmission substrate along the transmission direction.

In the endfire antenna apparatus, the reference adjacent distance is set to a length ranging from 0.46 to 2.23 times of a free-space wavelength of the electromagnetic wave.

Moreover, in the endfire antenna apparatus, the dielectric transmission substrate is a multilayer wiring substrate including a plurality of dielectric layers and a plurality of conductive layers. The conductive strip elements of the first conductive strip group are formed in a conductive layer on the surface of the dielectric transmission substrate, and the conductive strip elements of the second conductive strip group are formed in an inner conductive layer in the dielectric transmission substrate.

Further, in the endfire antenna apparatus, the conductive strip elements of the first conductive strip group and the conductive strip elements of the second conductive strip group are opposed to each other at least partial regions thereof.

Furthermore, in the endfire antenna apparatus, any two adjacent conductive strip elements from the conductive strip elements of the first conductive strip group oppose to one of the conductive strip elements of the second conductive strip group, in partial region thereof.

Moreover, in the endfire antenna apparatus, the multilayer loading structure includes a removed region which is a continuous region without placing the conductive strip elements, in a part of a region for placement of the multilayer loading structure along the transmission direction, and a length of the removed region ranges to 50% or less of a length of the region for placement.

Further, in the endfire antenna apparatus, the length of the removed region ranges between 10% and 20% of the length of the region for placement.

Furthermore, in the endfire antenna apparatus, the endfire antenna apparatus includes two multilayer loading structures consisting of: a first multilayer loading structure provided on a top side of the dielectric transmission substrate, and a second multilayer loading structure provided on a bottom side of the dielectric transmission substrate.

Moreover, in the endfire antenna apparatus, the dielectric transmission substrate is supported by a further dielectric substrate with a lower permittivity than that of the dielectric transmission substrate such that at least one of a top surface and a bottom surface of the dielectric transmission substrate contacts with a surface of the further dielectric substrate.

The endfire antenna apparatus of the present invention can achieve high gain characteristics with a small antenna structure in which the length of a dielectric transmission substrate is reduced as compared to conventional arts. According to the endfire antenna apparatus of the present invention, it is possible to obtain a high gain without increasing the area occupied by a circuit of the dielectric transmission substrate. Alternatively, according to the endfire antenna apparatus of the present invention, it is possible to reduce the area of an antenna unit, which cannot be achieved by conventional antenna design techniques.

BRIEF DESCRIPTION OF THE DRAWINGS

Various objects, features, and advantages of the present invention will be disclosed as preferred embodiments which are described below with reference to the accompanying drawings.

DETAILED DESCRIPTION OF THE PREFERRED EMBODIMENTS

Figure 1:
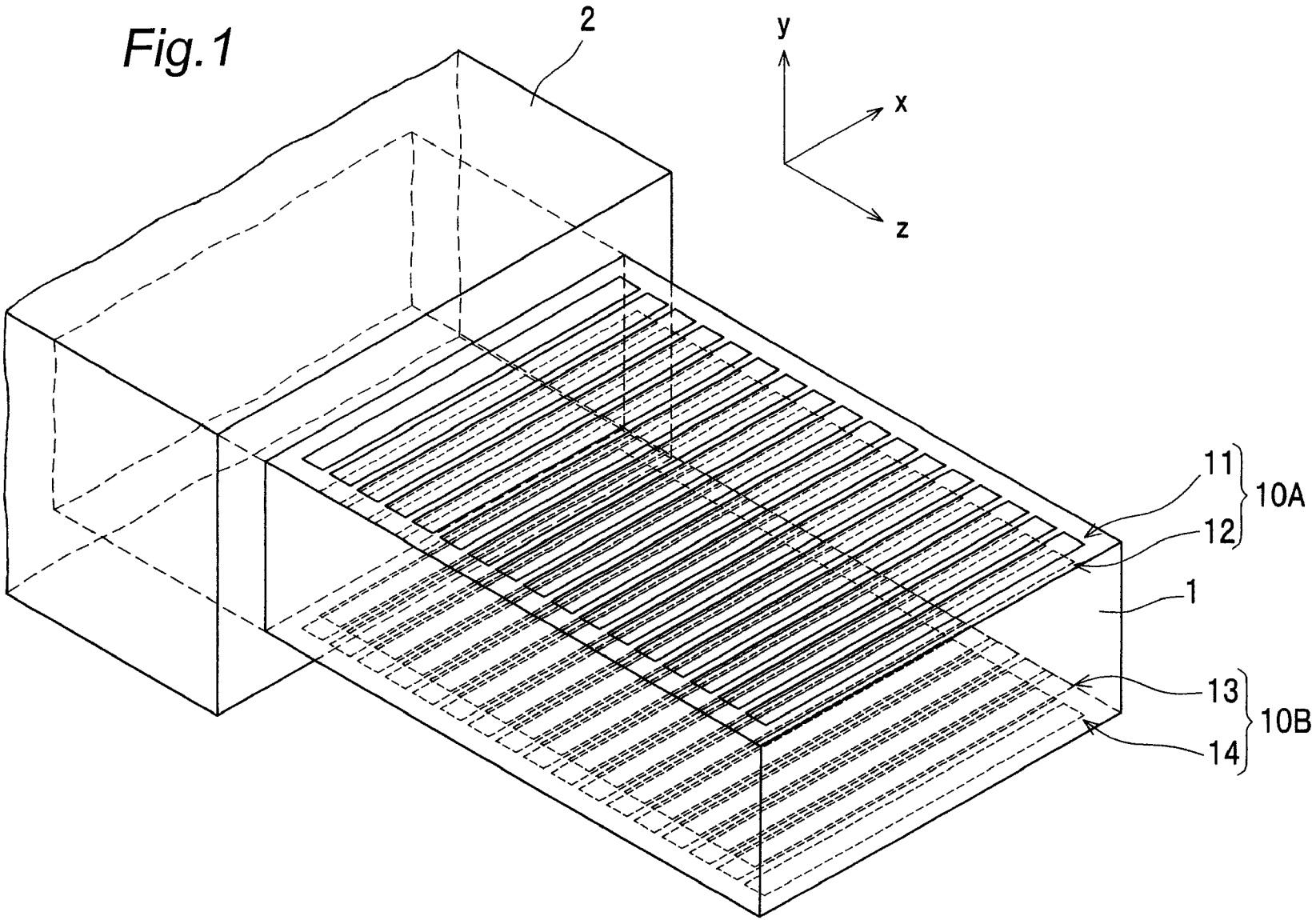
FIG. 1 shows a perspective view of a configuration of an endfire antenna apparatus according to a first preferred embodiment of the present invention, partially shown in a transparent view.

Preferred embodiments of the present invention will be described below with reference to the drawings. Note that components of similar functions are denoted by the same reference numerals throughout the drawings, and the descriptions thereof are not repeated.

First Preferred Embodiment

Figure 2:
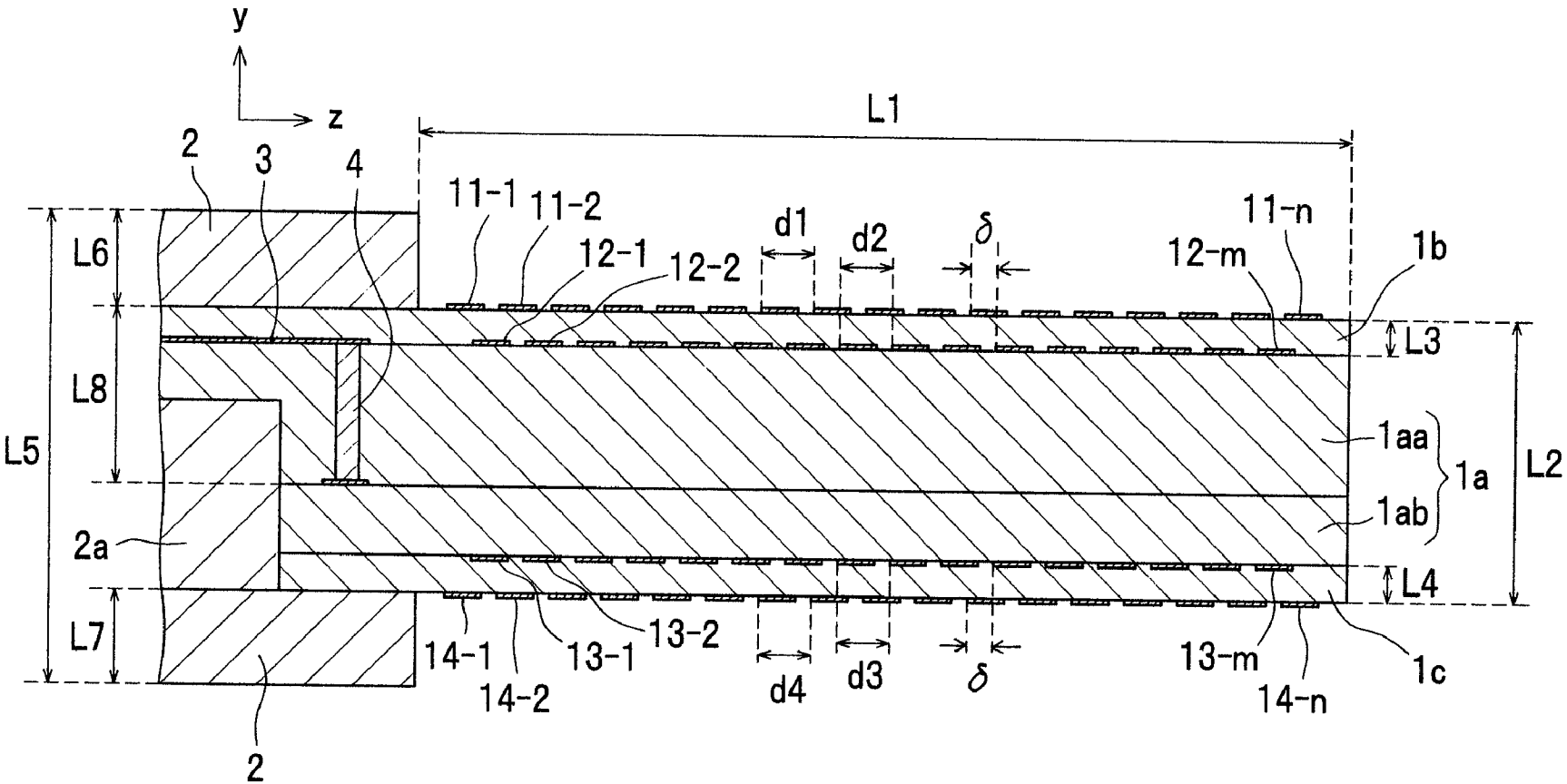
FIG. 2 shows a yz-plane cross-sectional view of the endfire antenna apparatus in FIG. 1.
Figure 3:
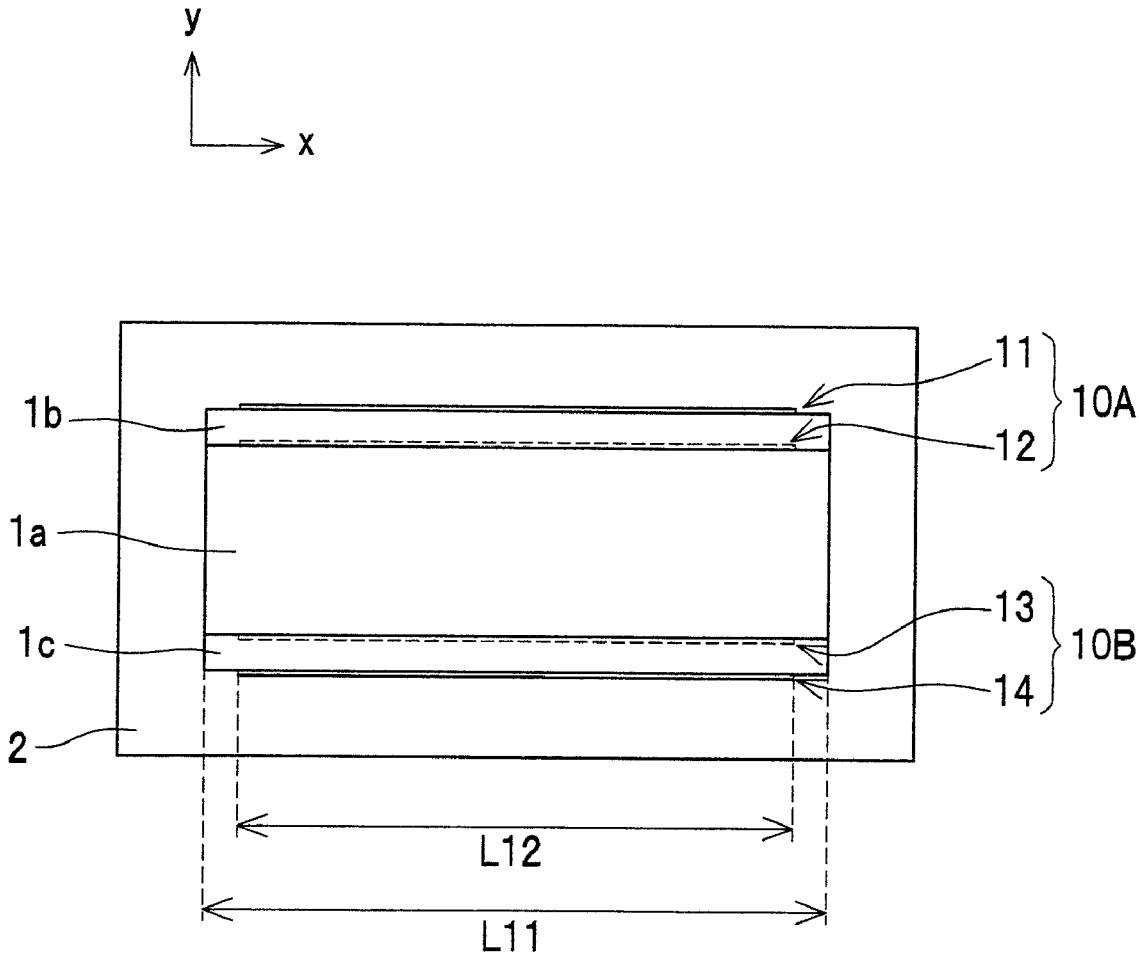
FIG. 3 shows a front view of the endfire antenna apparatus in FIG. 1 from +z direction.

FIG. 1 shows a perspective view of a configuration of an endfire antenna apparatus according to a first preferred embodiment of the present invention, partially shown in a transparent view. FIG. 2 shows a yz-plane central cross-sectional view of the endfire antenna apparatus in FIG. 1. FIG. 3 shows a front view of the endfire antenna apparatus in FIG. 1 from +z direction. The endfire antenna apparatus of the present preferred embodiment is an antenna that is provided with a dielectric transmission substrate 1 extending in a transmission direction, i.e., z-axis direction in FIG. 1, and a plurality of conductive strip elements provided to the dielectric transmission substrate 1 to be orthogonal to the z-axis direction, and that transmits an electromagnetic wave in the z-axis direction inside the dielectric transmission substrate 1 and along its surfaces, to radiate the electromagnetic wave from an end face in +z direction of the dielectric transmission substrate 1 (open end face). The endfire antenna apparatus of the present preferred embodiment is characterized by having multilayer loading structures 10A and 10B near a top surface and a bottom surface of the dielectric transmission substrate 1, each structure including conductive strip elements being placed much more densely than conventional arts, thus reducing the size of the endfire antenna apparatus, as well as increasing its gain.

In FIGS. 1 to 3, the dielectric transmission substrate 1 is shown in parallel with xz-plane. The dielectric transmission substrate 1 is divided into two regions: a shielded region in which surroundings of the dielectric transmission substrate 1 are electromagnetically shielded by a ground conductor 2; and a non-shielded region with a region length L1 where the dielectric transmission substrate 1 projects from an aperture of the shielded region (i.e., an end of the ground conductor 2 in the +z direction). As shown in FIG. 2, the dielectric transmission substrate 1 is configured as a multilayer wiring substrate including a dielectric layer 1*a*, and including dielectric layers 1*b* and 1*c* respectively provided above and below the dielectric layer 1*a*. The dielectric layer 1*a* further includes a dielectric layer 1*aa* and a dielectric layer 1*ab*. The dielectric transmission substrate 1 is further provided with conductive layers, each provided on a top side of the dielectric layer 1*b* (i.e., a top surface), a top side of the dielectric layer 1*a* (i.e., an inner layer between the dielectric layers 1*a* and 1*b*), a bottom side of the dielectric layer 1*a* (i.e., an inner layer between the dielectric layers 1*a* and 1*c*), and a bottom side of the dielectric layer 1*c* (i.e., a bottom surface). In the conductive layer on the top side of the dielectric layer 1*b*, a conductive strip group 11 is formed that includes a plurality of conductive strip elements 11-1, 11-2, . . . , 11-*n* placed in parallel to one another at intervals of a certain cycle or distance "d1" and to be orthogonal to the z-axis direction. In the conductive layer on the top side of the dielectric layer 1*a*, a conductive strip group 12 is formed that includes a plurality of conductive strip elements 12-1, 12-2, . . . , 12-*m* placed in parallel to one another at intervals of a certain cycle or distance "d2" and to be orthogonal to the z-axis direction. In the conductive layer on the bottom side of the dielectric layer 1*a*, a conductive strip group 13 is formed that includes a plurality of conductive strip elements 13-1, 13-2, . . . , 13-*m* placed in parallel to one another at intervals of a certain cycle or distance "d3" and to be orthogonal to the z-axis direction. Furthermore, in the conductive layer on the bottom side of the dielectric layer 1*c*, a conductive strip group 14 is formed that includes a plurality of conductive strip elements 14-1, 14-2, . . . , 14-*n* placed in parallel to one another at intervals of a certain cycle or distance "d4" and to be orthogonal to the z-axis direction. Each of the conductive strip groups 11, 12, 13, and 14 is provided in the non-shielded region of the dielectric transmission substrate 1, over the entire region in the z-axis direction. Hereinafter, the non-shielded region of the dielectric transmission substrate 1 is also referred to as the "region-for-placement" of the conductive strip elements (or the multilayer loading structures 10A and 10B). The conductive strip elements of the conductive strip group 11 and the conductive strip elements of the conductive strip group 12 are formed close to each other, with the dielectric layer 1*b* located therebetween, so that they are capacitively coupled to each other. Similarly, the conductive strip elements of the conductive strip group 13 and the conductive strip elements of the conductive strip group 14 are formed close to each other, with the dielectric layer 1*c* located therebetween, so that they are capacitively coupled to each other. The conductive strip groups 11 and 12 compose a multilayer loading structure 10A on the top side of the dielectric transmission substrate 1, by which a part of intra-substrate transmission electromagnetic wave components transmitted inside the dielectric transmission substrate 1 are leaked out of the surface of the dielectric transmission substrate 1, as surface transmission electromagnetic wave components. Similarly, the conductive strip groups 13 and 14 compose a multilayer loading structure 10B on the bottom side of the dielectric transmission substrate 1, by which a part of the intra-substrate transmission electromagnetic wave components are leaked out of the surface of the dielectric transmission substrate 1, as surface transmission electromagnetic wave components.

In endfire antenna apparatus according to the respective preferred embodiments of the present invention, an index referred to as a "reference adjacent distance d0" based on the aforementioned equation (2) is newly introduced to determine a distance at which the conductive strip elements are placed in each of the conductive strip groups 11, 12, 13, and 14. The reference adjacent distance "d0" is defined by the following equation:

$$d0 \equiv \lambda 0 / \left[\sqrt{\varepsilon_r} - 1\right] = k \cdot \lambda 0, \quad (3)$$

where "$\in_r$" denotes the relative permittivity of the dielectric layers 1*a*, 1*b*, and 1*c*, and k denotes a certain constant of proportionality. In the conventional dielectric leaky-wave antennas of Patent Document 1 etc., the radiation in a specific direction is increased selectively, because the electromagnetic waves leaking out of the surface of the dielectric transmission substrate are combined with each other at every effective wavelength. Thus, it can be understood that the reference adjacent distance "d0" defined by the equation (3) corresponds to the effective wavelength of spatial harmonic components transmitting along the dielectric transmission substrate, as well as increasing in strength. Conventionally, the placement of the loading elements at intervals of the reference adjacent distance results in generating spatial harmonics of the electromagnetic wave along the transmission direction on the surface of the dielectric transmission substrate. According to the equation (3), the reference adjacent distance "d0" is proportional to the free-space wavelength "λ0", and the constant of proportionality "k" depends on the relative permittivity of the dielectric transmission substrate. For example, with reference to the relative permittivity of Teflon (registered trademark) or alumina known as practical substrates for radio frequency circuits (about 2.1 to 10), the constant of proportionality "k" corresponds to a value in a range of 0.46 to 2.23. Note that in this case, it is not considered that the effective wavelength of the transmission path is affected by the multilayer loading structures provided on the surfaces of the dielectric transmission substrate.

In the present preferred embodiment, the cycle or distances d1, d2, d3, and d4, at which the conductive strip elements of the respective conductive strip groups 11, 12, 13, and 14 are placed, are set to a value smaller than the reference adjacent distance "d0", preferably a quarter or less of the reference adjacent distance "d0". In each of the conductive strip groups 11, 12, 13, and 14, the conductive strip elements are not necessarily placed at intervals of a constant adjacent distance, but may be placed at intervals of various different adjacent distances. Further, the adjacent distances and the numbers of conductive strip elements may be different among the conductive strip groups 11, 12, 13, and 14. For example, the conductive strip elements of the conductive strip group 11 may be placed at intervals of various different distances, with the minimum distance thereof being set to a quarter or less of the reference adjacent distance "d0", and the conductive strip elements of the other conductive strip groups 12, 13, and 14 may be placed at intervals of desired distances, respectively. As shown in FIG. 3, the conductive strip elements of the conductive strip groups 11, 12, 13, and 14 extend over a length L12 in x-axis direction, substantially equal to a width L11 of the dielectric transmission substrate 1. The endfire antenna apparatus of the present preferred embodiment can always achieve good performance, regardless of whether or not the conductive strip elements of the conductive strip groups 11, 12, 13, and 14 extend to both ends of the dielectric transmission substrate 1 in the x-axis direction. Accordingly, the effect of increasing gain is not reduced, even when the conductive strip elements are removed at the ends of the dielectric transmission substrate 1 in the x-axis direction, as shown in FIG. 3.

As shown in FIG. 2, the dielectric transmission substrate 1 is fed by a feed circuit in the shielded region (this is omitted in FIG. 1 for ease of illustration). Further, the dielectric transmission substrate 1 forms a transmission path in the non-shielded region, for transmitting an electromagnetic wave inside the dielectric transmission substrate 1 and along its surfaces toward a positive direction in z-axis, i.e., toward a transmission direction defined from the shielded region to the end face in the +z direction (open end face). As shown in FIG. 2, the feed circuit is provided with a feeder line 3 formed on the top side of the dielectric layer 1*a* (i.e., the conductive layer between the dielectric layers 1*a* and 1*b*) and connected to an external circuit (not shown), and a via conductor 4 connected to an end of the feeder line 3 and penetrating through the dielectric layer 1*aa* in y-axis direction. A configuration including the via conductor 4 can be formed in a conventional process upon manufacturing the dielectric transmission substrate 1 which is of a multilayer wiring substrate, thus resulting in no increase in manufacturing costs. The configuration for feeding the dielectric transmission substrate 1 is not limited to one including the via conductor 4 at the end of the feeder line 3, and other configurations may be used. For example, the end of the feeder line 3 may be branched off, and the branched end may be used as an open end stub to excite the dielectric transmission substrate 1.

The ground conductor 2 is made of, for example, a solid conductor enclosing the dielectric transmission substrate 1 by certain thickness. Alternatively, the ground conductor 2 may be configured by surrounding the dielectric transmission substrate 1 with a plurality of via conductors arranged close to each other. The structure of the ground conductor 2 for electromagnetically shielding the dielectric transmission substrate 1 in the shielded region can act as a cavity by which undesired electromagnetic waves radiating in a rearward direction (−z direction) in the endfire antenna apparatus of the present preferred embodiment are reflected to a forward direction (+z direction). In other words, it is possible to design the endfire antenna apparatus of the present preferred embodiment by using the ground conductor 2, so as to achieve an effect equivalent to substantially extending an antenna aperture. The endfire antenna apparatus of the present preferred embodiment may be further provided with a ground conductor 2*a* in the dielectric transmission substrate 1, serving as a reflective conductor by which the electromagnetic waves excited from the via conductor 4 are reflected to the +z direction. Further, gaps may be provided between the ground conductor 2 and the dielectric transmission substrate 1, and the gaps may be filled by air, or by a low-permittivity dielectric substrate to be newly incorporated. In the endfire antenna apparatus of the present preferred embodiment, it is also possible to set a reflection plane for the surface transmission electromagnetic wave components, at a plane other than the plane including the aperture of the shielded region, thus further increasing the design flexibility.

Now, the function of the multilayer loading structures 10A and 10B will be described. The function of the multilayer loading structures 10A and 10B of the endfire antenna apparatus according to each preferred embodiment of the present invention is different from that of the loading elements of the conventional dielectric leaky-wave antennas. In the conventional arts such as Patent Documents 1 to 3 and Non-Patent Document 1, the loading elements (or metal strips) are provided for the purpose of regularly and in-phase combining the electromagnetic wave components to be radiated and thus selectively increasing them, by using the wave properties of electromagnetic waves. Hence, the adjacent distance "d" of the loading elements must have a value that strictly satisfies the equation (2) (i.e., a distance substantially equal to the reference adjacent distance "d0"). For example, in either case that the adjacent distance "d" is half or quarter of the reference adjacent distance "d0", the effect of increasing gain cannot be achieved. On the other hand, in the multilayer loading structures 10A and 10B of the endfire antenna apparatus according to each preferred embodiment of the present invention, the adjacent distances d1, d2, d3, and d4 of the conductive strip elements of the respective conductive strip groups 11, 12, 13, and 14 are set to d0/4 or less, at least in a partial region. For example, in the multilayer loading structure 10A on the top side of the dielectric transmission substrate 1, when setting d1=d2=d0/12, and displacing the conductive strip elements of the conductive strip group 11 and the conductive strip elements of the conductive strip group 12 from each other by a distance $\delta$<d0/12 along the transmission direction (z-axis direction), the adjacent distance between the conductive strip elements along the transmission direction is an extremely small value relative to the reference adjacent distance "d0". However, as will be described later, an endfire antenna apparatus according to an implemental example of the present invention fabricated under the above-described conditions achieves an effect of increasing gain much greater than that of the conventional antennas. This implies that each preferred embodiment of the present invention produces a new effect that cannot be expected in the conventional design techniques based on the combination of waves.

Generally, in a dielectric leaky-wave antenna, the propagation speed of intra-substrate transmission electromagnetic wave components, propagating through a dielectric transmission substrate and radiating in a desired direction from an open end of the dielectric transmission substrate, is different from that of surface transmission electromagnetic wave components, radiating in the desired direction while propagating along an interface between the dielectric transmission substrate and air. The former has a slower propagation speed because of the propagation inside the dielectric, and the latter has a faster propagation speed because of the permittivity of air lower than that of the substrate. Nevertheless, in the conventional antennas, such speed difference does not cause a severe adverse effect. because most of electromagnetic wave energy fed into the dielectric transmission substrate is converted into the surface transmission electromagnetic wave components since the length of the dielectric transmission substrate is set to be sufficiently long, and thus, only the surface transmission electromagnetic wave components should be considered upon design. As is indicated in Table 3 of Non-Patent Document 1, a conventional antenna is designed such that residual energy at the open end is set to 10%. That is, in the conventional antenna, 90% of input energy is converted into the surface transmission electromagnetic wave components. On the other hand, the endfire antenna apparatus according to each preferred embodiment of the present invention is intended to achieve a high gain under the condition of a reduced region length for the non-shielded region of the dielectric transmission substrate 1 (substantially corresponding to the length of a substrate of the conventional antennas), and accordingly, a radiation in a desired direction (i.e., the +z direction) should be efficiently produced from the intra-substrate transmission electromagnetic wave components. Thus, it is necessary to reduce the difference in propagation speed between the intra-substrate transmission electromagnetic wave components and the surface transmission electromagnetic wave components, and to adjust these two radiation components in phase. Each preferred embodiment of the present invention produces wiring capacities between the conductive strip elements densely placed on the surface layers of the dielectric transmission substrate 1, thus selectively increasing the effective permittivity for the surface transmission electromagnetic wave components. Accordingly, since each preferred embodiment of the present invention reduces the difference in propagation speed between the intra-substrate transmission electromagnetic wave components and the surface transmission electromagnetic wave components, a combined electromagnetic wave of these two electromagnetic wave components efficiently contributes to a radiation in the +z direction.

Further, discontinuous transition of a transmission path structure from the shielded region to the non-shielded region causes wasteful energy leakage from the dielectric transmission substrate to air, thus hindering from achieving high gain characteristics. In the endfire antenna apparatus according to each preferred embodiment of the present invention, this energy loss can be suppressed by incorporating the multilayer loading structures 10A and 10B in which conductive strip elements are densely placed. As a result, particularly in the case of adopting a resin substrate with low permittivity, it is possible to relatively increase a ratio in strength of intra-substrate transmission electromagnetic wave components to surface transmission electromagnetic wave components, as compared to that of the conventional arts. Thus, it is possible to obtain a high gain even under the condition of a reduced region length L1 for the non-shielded region of the dielectric transmission substrate 1.

Figure 4:
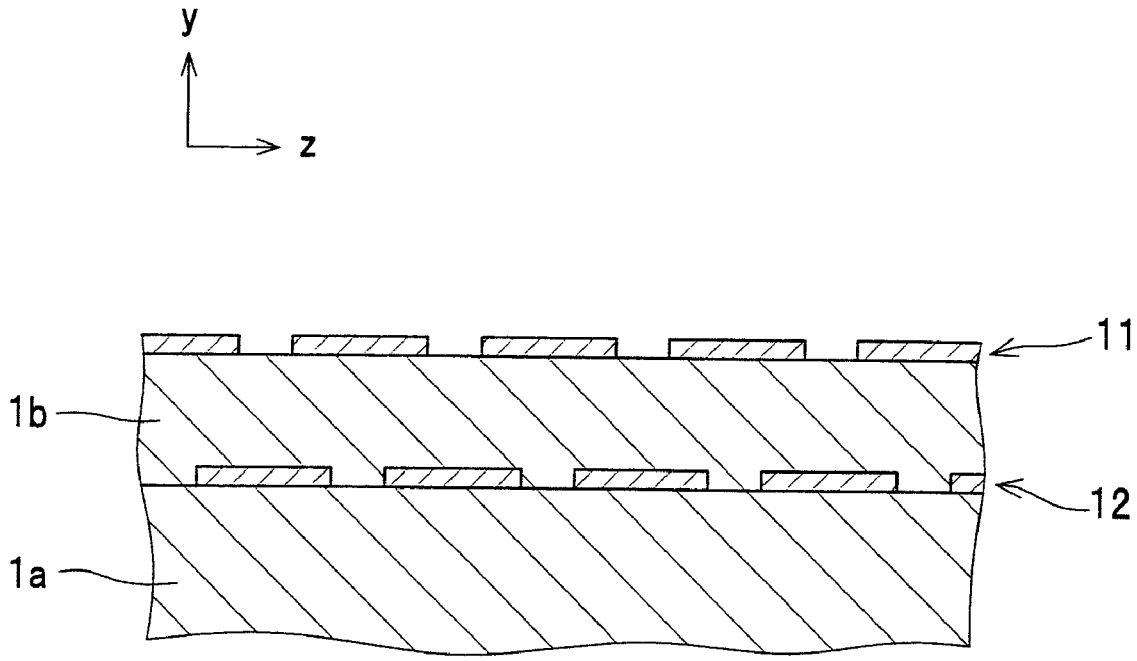
FIG. 4 shows an enlarged view of a portion including conductive strip groups 11 and 12 in the cross-sectional view of FIG. 2.
Figure 5:
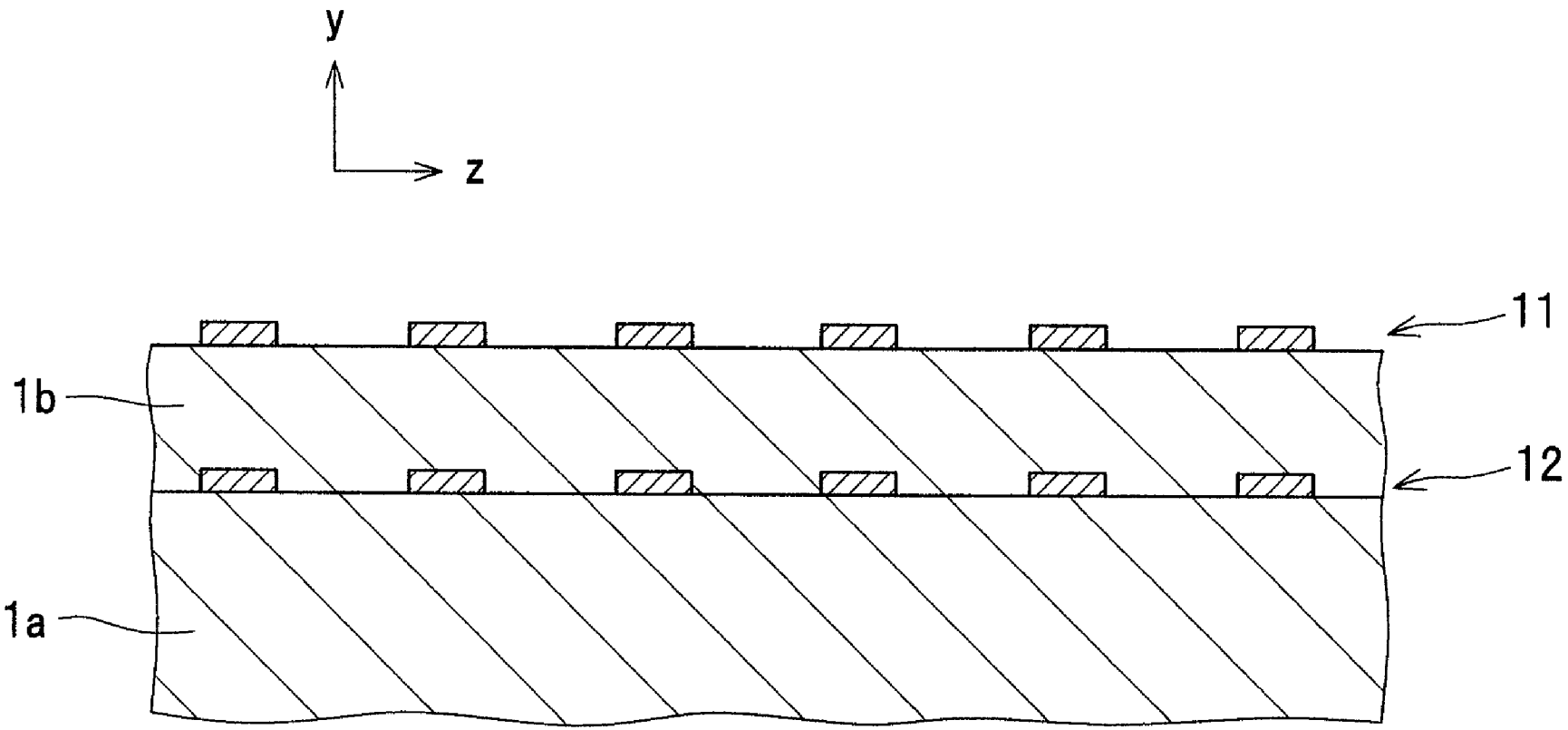
FIG. 5 is a yz-plane cross-sectional view showing a configuration of an endfire antenna apparatus according to a modified preferred embodiment of the first preferred embodiment of the present invention, and enlarging a portion including conductive strip groups 11 and 12.

Next, a detailed configuration of the multilayer loading structures 10A and 10B will be described. FIG. 4 shows an enlarged view of a portion including the conductive strip groups 11 and 12 in the cross-sectional view of FIG. 2. FIG. 5 is a yz-plane cross-sectional view showing a configuration of an endfire antenna apparatus according to a modified preferred embodiment of the first preferred embodiment of the present invention, and enlarging a portion including conductive strip groups 11 and 12. As shown in FIGS. 4 and 5, it is preferable that in the multilayer loading structure 10A on the top side of the dielectric transmission substrate 1, the conductive strip elements of the conductive strip group 11 and the conductive strip elements of the conductive strip group 12 are placed so as to oppose to each other (i.e., overlap with each other as viewed from +y direction) at least partial regions thereof, in order to obtain high cross-capacitances between them. Preferably, as shown in FIG. 4, the conductive strip elements of the conductive strip group 11 and the conductive strip elements of the conductive strip group 12 are displaced from each other along the transmission direction (z-axis direction) so as to successively obtain the cross-capacitances between the conductive strip elements along the z-axis direction. Specifically, it is preferable that any two adjacent conductive strip elements from the conductive strip elements of the conductive strip group 11 oppose to one of the conductive strip elements of the conductive strip group 12, in partial region thereof. The multilayer loading structure 10A of the present preferred embodiment is not limited to having the configuration in which the conductive strip elements of the conductive strip group 11 are displaced from the conductive strip elements of the conductive strip group 12, as shown in FIG. 4. As long as the cross-capacitances can be obtained between the conductive strip elements, the multilayer loading structure 10A may be configured as shown in FIG. 5. Note that according to simulations conducted by the inventor, the performance of the endfire antenna apparatus according to each preferred embodiment of the present invention does not depend on values of the capacitances formed between the conductive strip elements in the multilayer loading structure 10A. Namely, the endfire antenna apparatus of the present preferred embodiment can achieve an effect of substantially increasing gain as compared to the conventional dielectric leaky-wave antennas, as long as capacitances is formed between the conductive strip elements in the multilayer loading structure 10A. Also in the multilayer loading structure 10B on the bottom side of the dielectric transmission substrate 1, the conductive strip groups 13 and 14 are configured in the same manner as the conductive strip groups 11 and 12.

The dielectric transmission substrate 1 is configured, for example, as a Low Temperature Co-fired Ceramic (LTCC) substrate. Each of the conductive strip groups 11, 12, 13, and 14 can be readily formed by conventional patterning processes for multilayer printed wiring boards or low temperature co-fired ceramic processes, and their thickness is of the order of 10 μm in practice.

Although in the present preferred embodiment, the multilayer loading structures 10A and 10B are respectively provided on both the top side and bottom side of the dielectric transmission substrate 1, a multilayer loading structure may be provided on only one side, if necessary. Generally, if patterning conductive strip elements on only one side of a thin dielectric transmission substrate, then the substrate may be warped, and this warp may cause breaks, cracks, etc. during its assembling process. On the other hand, when the multilayer loading structures 10A and 10B are respectively formed on both the top side and bottom side of the dielectric transmission substrate 1 as in the present preferred embodiment, the warp of the dielectric transmission substrate 1 itself is substantially reduced, and thus, the occurrence of breaks and cracks can be significantly reduced. Further, if a phase shift occurs between the intra-substrate transmission electromagnetic wave components, propagating through the dielectric transmission substrate and radiating from the open end of the dielectric transmission substrate, and the surface transmission electromagnetic wave components, propagating and radiating through an interface between the dielectric transmission substrate and air, then the direction of a combined radiation beam may be tilted. In order to also avoid such a tilt phenomenon of a main beam direction, it is preferable that the multilayer loading structures 10A and 10B is formed respectively on both the top side and bottom side of the dielectric transmission substrate 1.

Each of the multilayer loading structures 10A and 10B on the top side and bottom side of the dielectric transmission substrate 1 is not necessarily configured in a two layers. It is also possible to adopt a multilayer loading structure which includes three or more layers of conductive strip groups, and in which conductive strip elements of the respective conductive strip groups are capacitively coupled to one another.

As described above, the endfire antenna apparatus of the present preferred embodiment can achieve high gain, as well as reduction in size.

Second Preferred Embodiment

Figure 6:
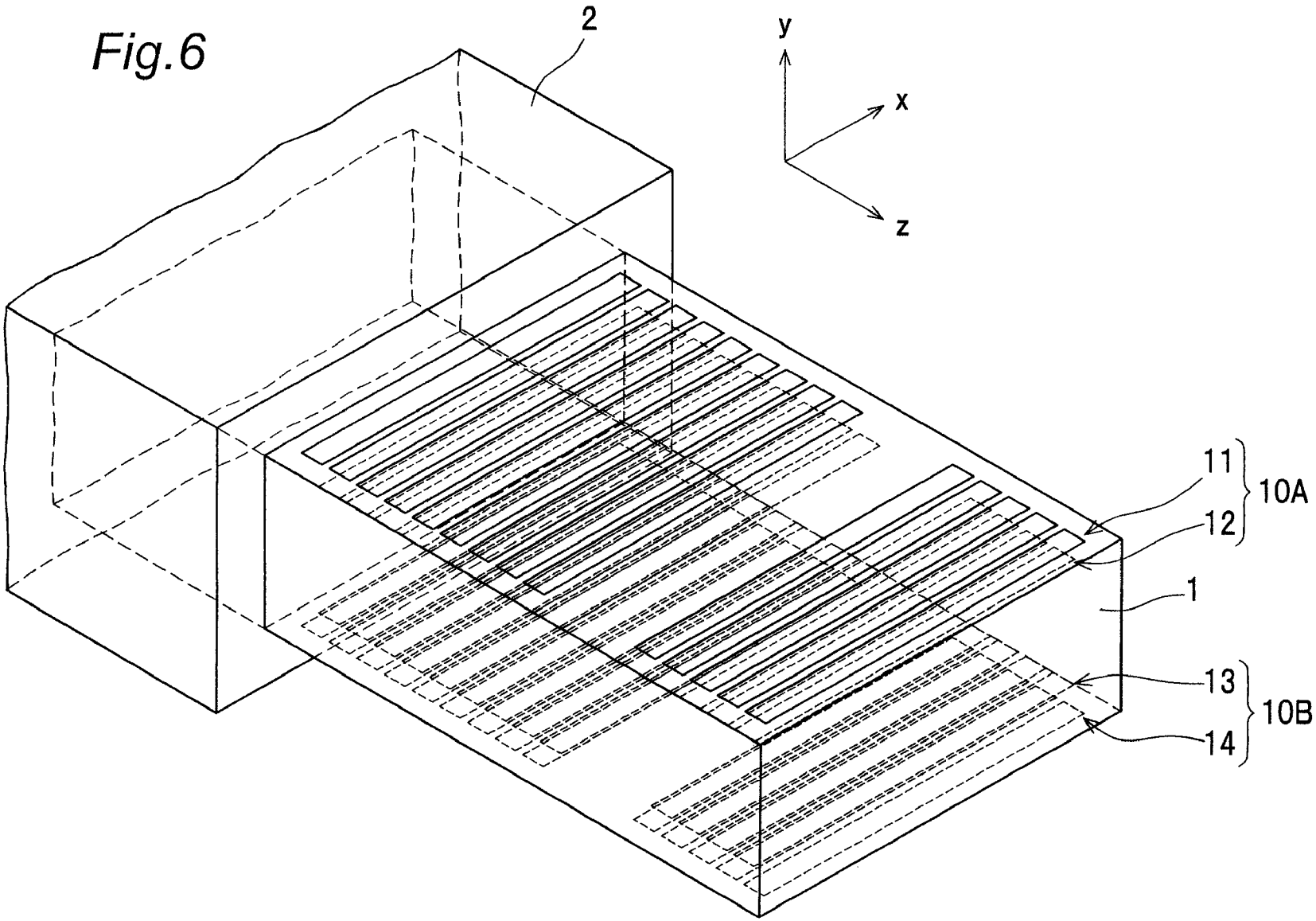
FIG. 6 shows a perspective view of a configuration of an endfire antenna apparatus according to a second preferred embodiment of the present invention, partially shown in a transparent view.
Figure 7:
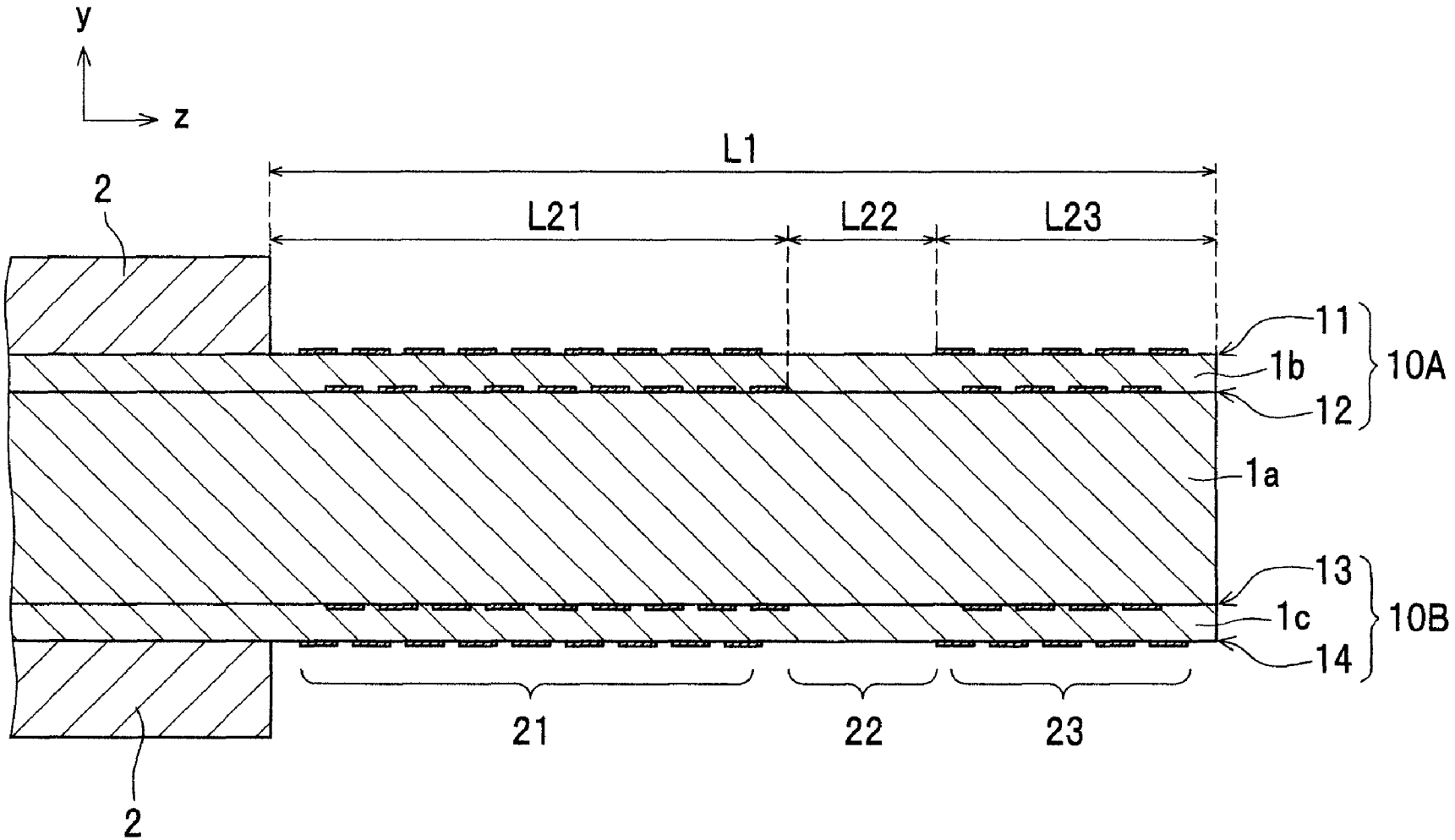
FIG. 7 shows a yz-plane cross-sectional view of the endfire antenna apparatus in FIG. 6.

FIG. 6 shows a perspective view of a configuration of an endfire antenna apparatus according to a second preferred embodiment of the present invention, partially shown in a transparent view. FIG. 7 shows a yz-plane cross-sectional view of the endfire antenna apparatus in FIG. 6. In FIGS. 6 and 7, detailed configurations of a dielectric transmission substrate 1 and a feed circuit are omitted, because they are the same as those in the first preferred embodiment. The endfire antenna apparatus of the present preferred embodiment is characterized by including a removed region 22 which is a continuous region without placing conductive strip elements, in part of the region-for-placement of the multilayer loading structures. As shown in FIG. 7, in a non-shielded region of the dielectric transmission substrate 1 with a region length L1 (i.e., the region-for-placement of multilayer loading structures 10A and 10B), each of the multilayer loading structures 10A and 10B on a top side and a bottom side of the dielectric transmission substrate 1 includes a first region 21 with a region length L21 close to a ground conductor 2, and a second region 23 with a region length L23 close to an end face in +z direction of the dielectric transmission substrate 1, and further includes a removed region 22 with a region length L22 between the first and second regions. The region length L22 of the removed regions 22 is preferably set to 50% or less of the region length L1 of the region-for-placement, more preferably, set to 10% to 20%. In each of the multilayer loading structures 10A and 10B, the region length L21 of the first region 21 is preferably set to 50% or more of the region length L1 of the region-for-placement.

The removed regions 22 is provided for the purpose of suppressing side lobes. When the non-shielded region is configured with a region length L1 that exceeds one free-space wavelength in an operating band, if the multilayer loading structures 10A and 10B are placed over the entire non-shielded region, it tends to increase undesired radiations in directions other than a desired direction (+z direction), and such radiations are not preferable for some applications. The undesired radiations can be effectively suppressed by providing the removed regions 22. Extending the region length L22 of the removed regions 22 adversely affects the first object of the present invention, i.e., reduces the effect of efficient radiation in the desired direction (+z direction). However, according to a third implemental example described later, the effect of increasing gain is maintained as long as the region length L22 of the removed regions 22 ranges to 50% or less of the region length L1 of the region-for-placement. Further, it is observed that the sidelobe suppression effect tends to suddenly increase when the region length L22 of the removed regions 22 is 10% or more of the region length L1 of the region-for-placement, and to be saturated when exceeding larger than 20%. When the region length L22 of the removed regions 22 is set to 20% of the region length L1 of the region-for-placement, little degradation in gain occurs. According to these results, the region length L22 of the removed regions 22 is preferably set to 50% or less of the region length L1 of the region-for-placement, more preferably to between 10% and 20%.

In the conventional antennas, the loading elements or the metal strips should be placed periodically. Accordingly, removing the loading elements or the metal strips in a partial region adversely affects the effect of periodical combination of electromagnetic waves, thus resulting in noticeable degradation in gain characteristics. Incorporating the removed regions 22 into the present preferred embodiment does not causes noticeable gain degradation, and this fact itself proves that the function of the multilayer loading structures 10A and 10B according to each preferred embodiment of the present invention is different from that of the loading elements or metal strips of the conventional art. Further, according to the above reasons, the conductive strips of the multilayer loading structures 10A and 10B according to each preferred embodiment of the present invention are not necessarily placed at intervals of a constant adjacent distance.

As described above, the endfire antenna apparatus of the present preferred embodiment can achieve high gain, reduction in size, and suppression of sidelobes.

Third Preferred Embodiment

Figure 8:
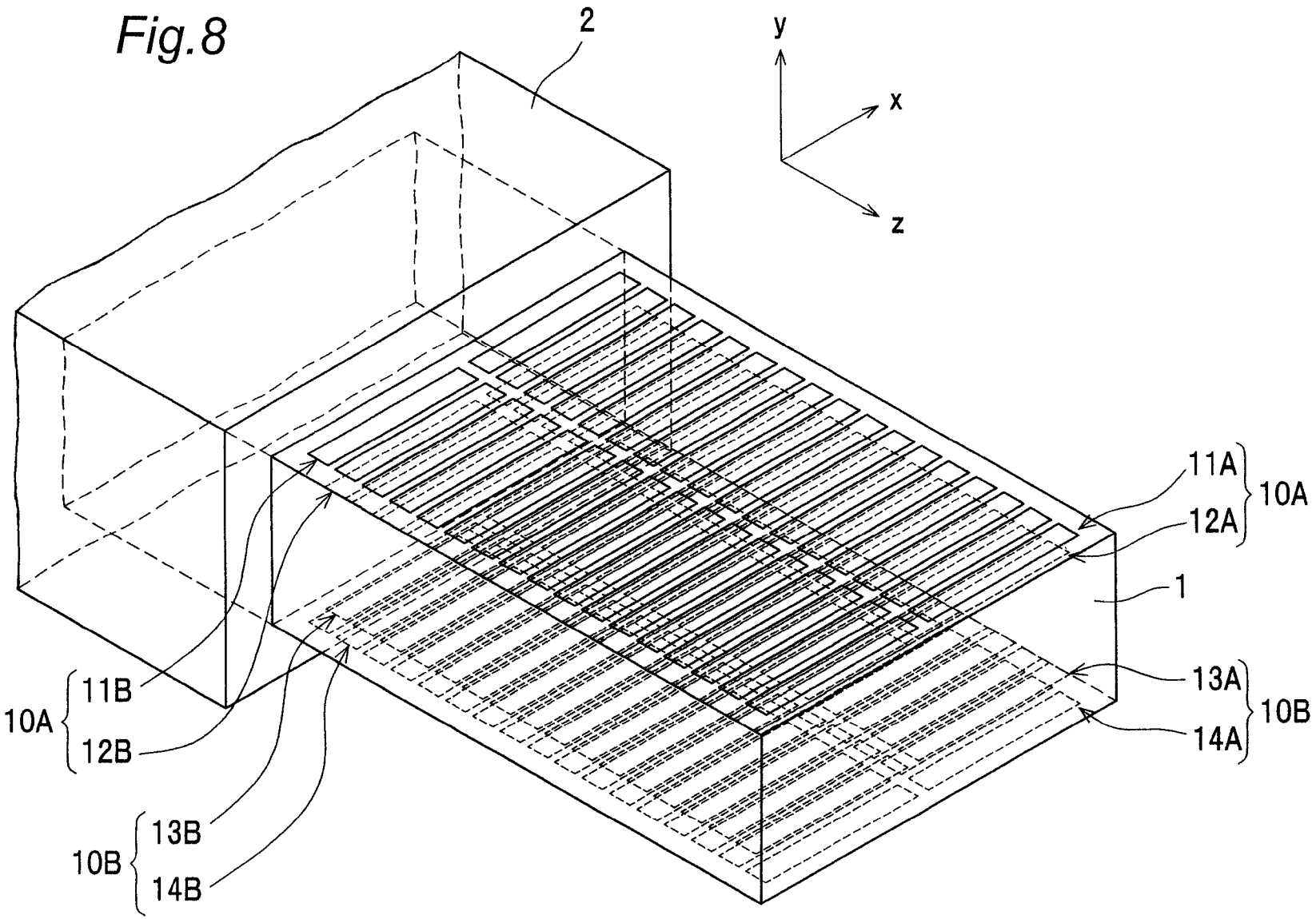
FIG. 8 shows a perspective view of a configuration of an endfire antenna apparatus according to a third preferred embodiment of the present invention, partially shown in a transparent view.

FIG. 8 shows a perspective view of a configuration of an endfire antenna apparatus according to a third preferred embodiment of the present invention, partially shown in a transparent view. In the endfire antenna apparatus according to the preferred embodiment of the present invention, conductive strip elements composing multilayer loading structures 10A and 10B are not necessarily formed over the entire length in a width direction of a dielectric transmission substrate 1. The endfire antenna apparatus of the present preferred embodiment is characterized by including conductive strip groups 11A and 11B, 12A and 12B, 13A and 13B, and 14A and 14B, which are configured by dividing into two parts the conductive strip groups 11, 12, 13, and 14 of the endfire antenna apparatus of the first preferred embodiment, at the center in the width direction (x-axis direction). Even when the conductive strip elements of all conductive strip groups in the endfire antenna apparatus are thus divided into two parts at the center in the width direction of the dielectric transmission substrate 1, it is possible to have advantageous effects according to the preferred embodiment of the present invention, without any significant change in radiation characteristics and reflection characteristics in an operating band.

Fourth Preferred Embodiment

Figure 9:
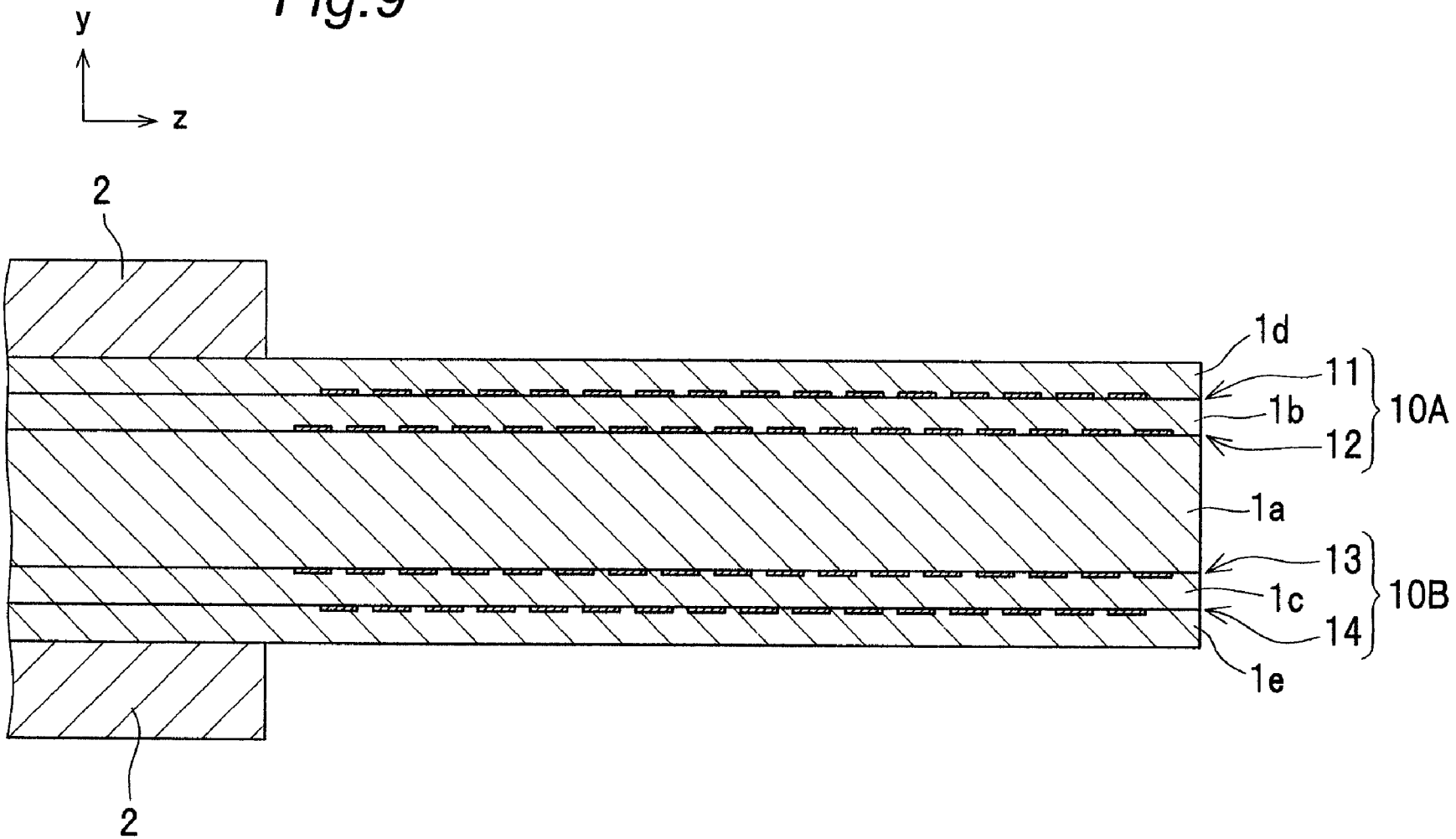
FIG. 9 is a yz-plane cross-sectional view showing a configuration of an endfire antenna apparatus according to a fourth preferred embodiment of the present invention.
Figure 10:
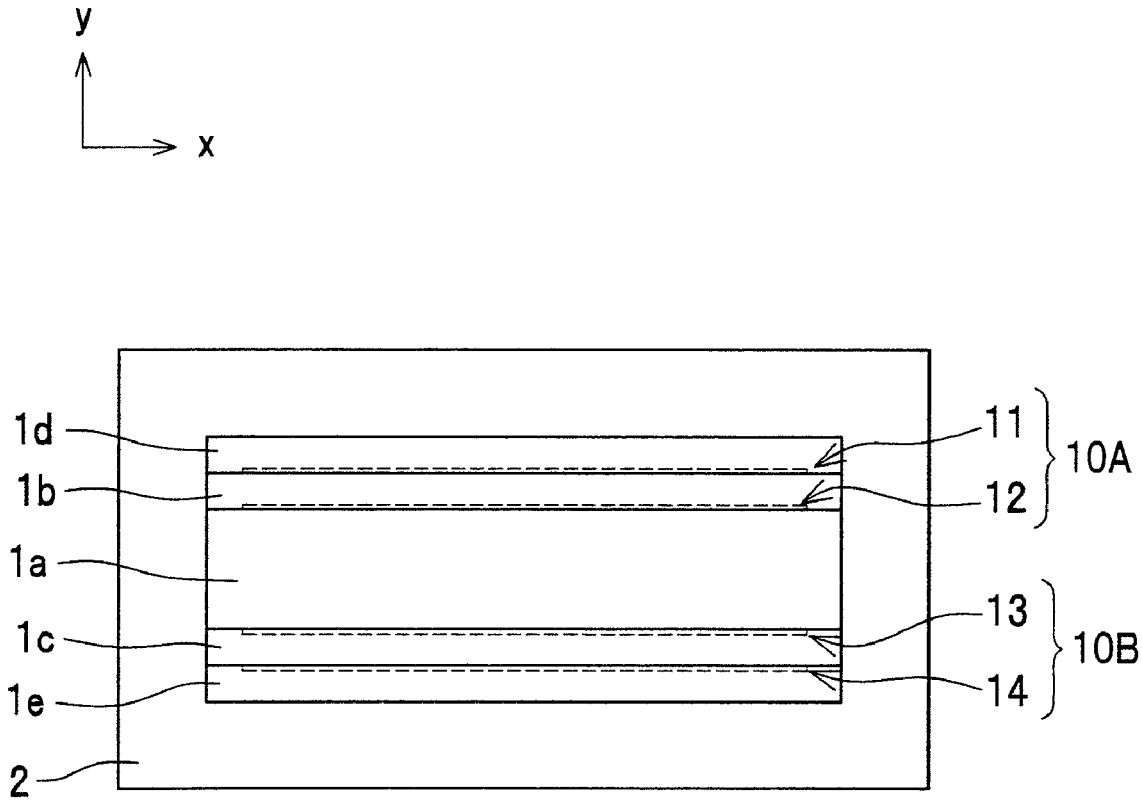
FIG. 10 shows a front view of the endfire antenna apparatus in FIG. 9 from +z direction.

FIG. 9 is a yz-plane cross-sectional view showing a configuration of an endfire antenna apparatus according to a fourth preferred embodiment of the present invention. FIG. 10 shows a front view of the endfire antenna apparatus in FIG. 9 from +z direction. As shown in FIGS. 9 and 10, in the endfire antenna apparatus according to the preferred embodiment of the present invention, a part of conductive strip elements composing multilayer loading structures 10A and 10B (i.e., conductive strip elements of conductive strip groups 11 and 14) are not necessarily exposed to surface layers of a dielectric transmission substrate 1. However, when providing the multilayer loading structures 10A and 10B on surfaces of the dielectric transmission substrate 1, it is possible to maximize the effect of the present invention for increasing the effective permittivity of leaky waves on dielectric, and thus, such a configuration is preferred as an embodiment.

Fifth Preferred Embodiment

Figure 11:
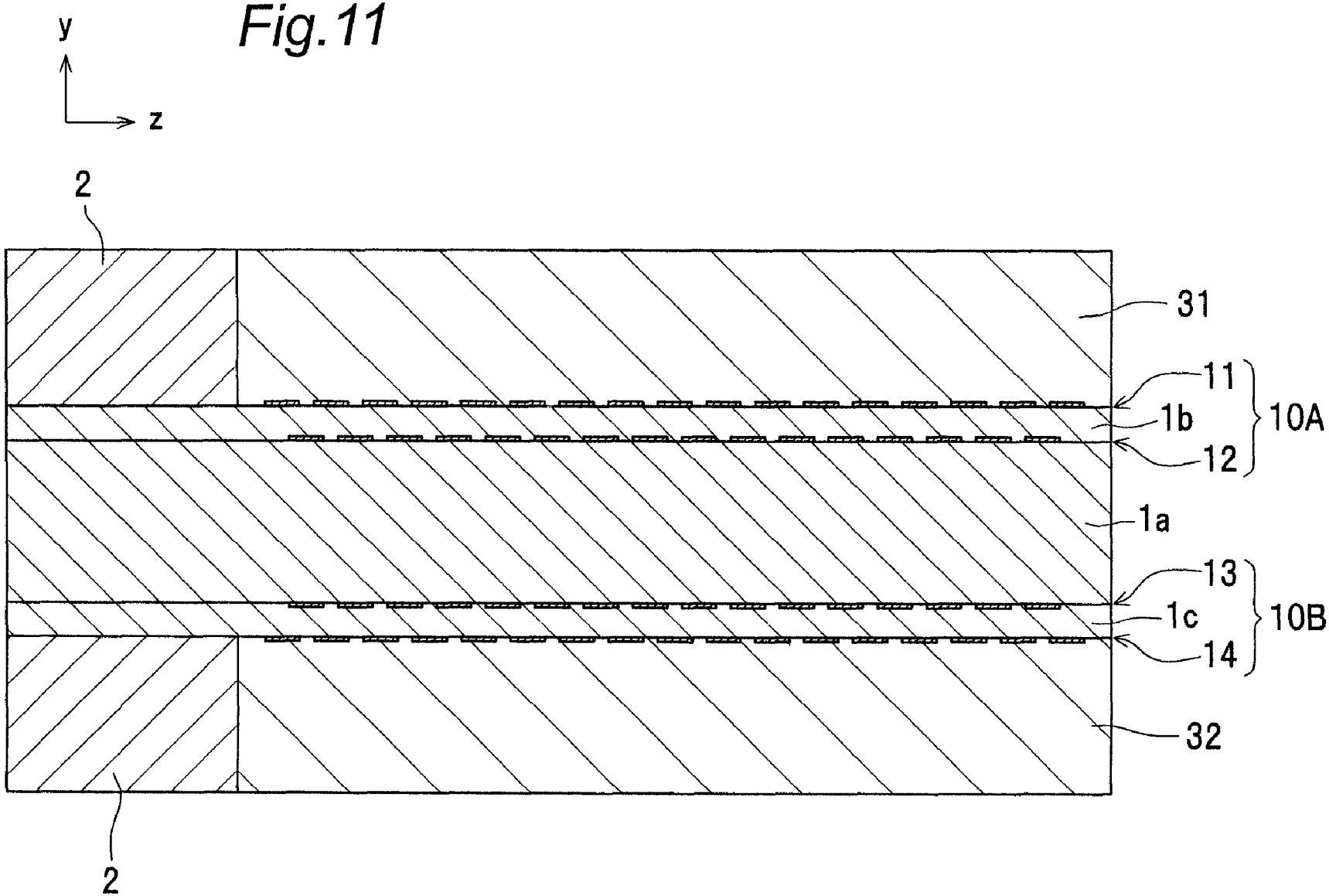
FIG. 11 is a yz-plane cross-sectional view showing a configuration of an endfire antenna apparatus according to a fifth preferred embodiment of the present invention.
Figure 12:
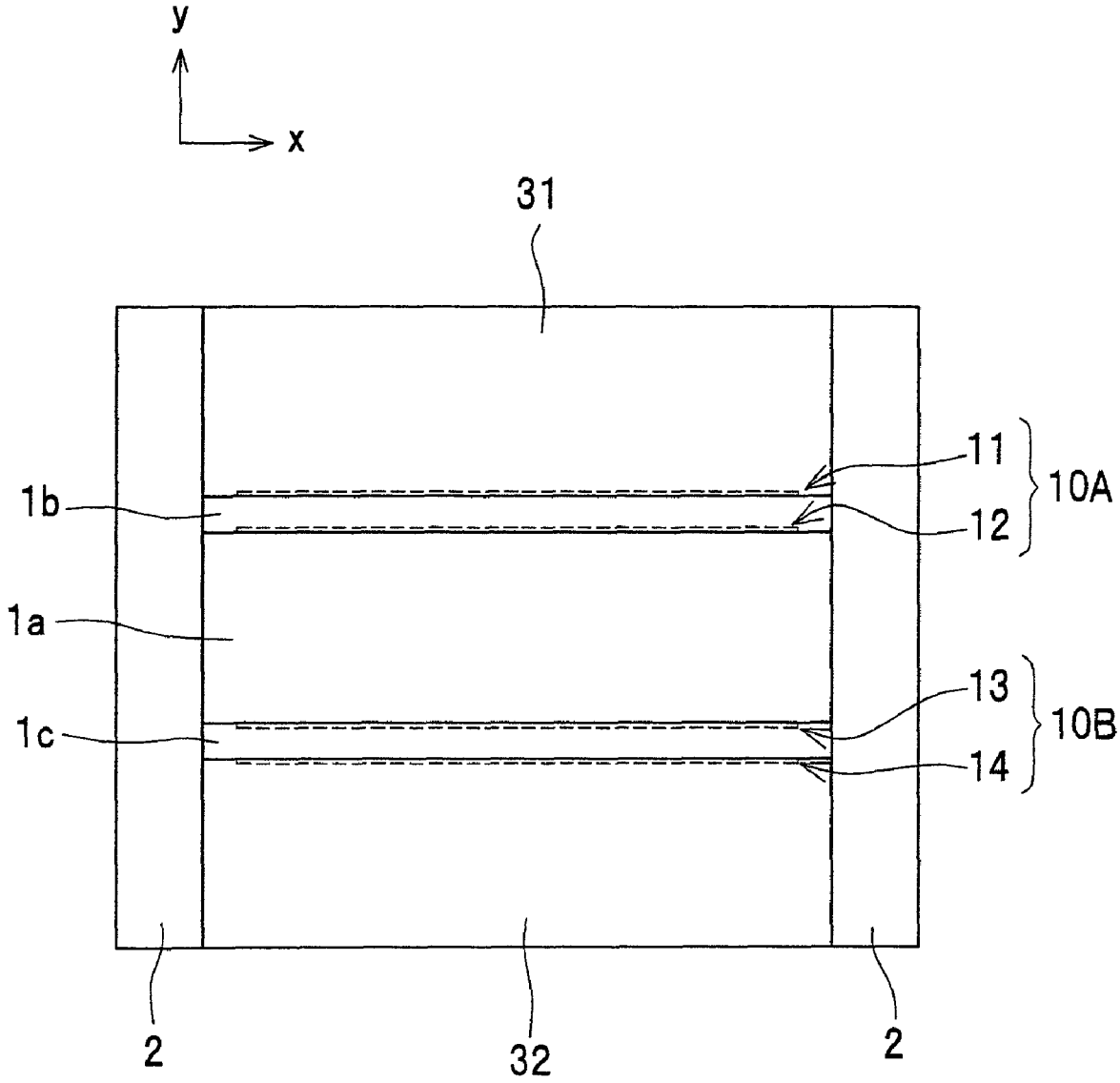
FIG. 12 shows a front view of the endfire antenna apparatus in FIG. 11 from +z direction.

FIG. 11 is a yz-plane cross-sectional view showing a configuration of an endfire antenna apparatus according to a fifth preferred embodiment of the present invention. FIG. 12 shows a front view of the endfire antenna apparatus in FIG. 11 from +z direction. The endfire antenna apparatus of the present preferred embodiment is characterized by supporting a dielectric transmission substrate 1 such that a bottom surface or both top and bottom surfaces of the dielectric transmission substrate 1 contacts with a surface(s) of dielectric substrates 31 and 32, at least in part of a non-shielded region of the dielectric transmission substrate 1. The dielectric substrates 31 and 32 have lower permittivity than that of the dielectric transmission substrate 1 in which multilayer loading structures 10A and 10B are provided. By adding the dielectric substrates 31 and 32, it is possible to improve the mechanical strength of the endfire antenna apparatus. In addition, by adopting the dielectric substrates 31 and 32 with low permittivity, it is possible to keep changes in circuit design parameters to a minimum; the parameters including: the proportion of electromagnetic waves leaking out of the dielectric transmission substrate 1, and the propagation constant of leaky waves on dielectric, etc.

First Implemental Example

Simulation results obtained for an endfire antenna apparatus according to an implemental example of the present invention and for antennas of comparative examples based on the conventional art will be described below.

First, a configuration of an endfire antenna apparatus according to the implemental example of the present invention will be described with reference to FIGS. 1 to 4. A dielectric transmission substrate 1 was a ceramic substrate with a thickness L2=0.7 mm, a width L11=3.8 mm, and a permittivity of 4.9. A ground conductor 2 had a height L5=3.7 mm, and was configured to extend from a top side of the dielectric transmission substrate 1 by L6=1.5 mm, and from a bottom side of the dielectric transmission substrate 1 by L7=1.5 mm. In a feed circuit, a via conductor 4 had a diameter of 100 microns, and extended to a position of a depth L8=400 microns from the top side of the dielectric transmission substrate 1, and achieved a good reflection characteristic of minus 10 dB or less at 60 GHz. In a multilayer loading structure 10A on the top side of the dielectric transmission substrate 1, conductive strip elements of respective conductive strip groups 11 and 12 were capacitively coupled to each other, through a dielectric layer 1*b* with a thickness L3=85 microns. In a multilayer loading structure 10B on the bottom side of the dielectric transmission substrate 1, conductive strip elements of respective conductive strip groups 13 and 14 were capacitively coupled to each other, through a dielectric layer 1*c* with a thickness L4=85 microns. The conductive strip elements of the respective conductive strip groups 11 and 14 were placed such that their projections completely overlapped with each other, as viewed from +y direction. Similarly, the conductive strip elements of the respective conductive strip groups 12 and 13 were placed such that their projections completely overlapped with each other, as viewed from the +y direction. Note that the conductive strip elements of the respective conductive strip groups 11 and 12 were displaced from each other by a length δ=d0/24 along z-axis direction, and the conductive strip elements of the respective conductive strip groups 13 and 14 were also displaced from each other by a length δ=d0/24 along the z-axis direction. All the conductive strip elements had a length L12=3.4 mm in x-axis direction, and had a width of d0/18 in the z-axis direction.

On the other hand, antennas of first to fourth comparative examples had configurations different from the configuration of the implemental example as follows. An antenna of the first comparative example was configured with no conductive strip element. An antenna of the second comparative example was provided with conductive strip elements placed on only surface layers on a top side and a bottom side of a dielectric transmission substrate 1 at intervals of a adjacent distance "d" (=d0), instead of the conductive strip elements of the conductive strip groups 11, 12, 13, and 14 according to the implemental example of the present invention. In the dielectric transmission substrate 1 of the second comparative example, the conductive strip elements on the top side and the conductive strip elements on the bottom side were displaced from each other by λg/4 along z-axis direction, where λg denotes a guide wavelength inside the transmission path. Hence, the configuration of the antenna of the second comparative example corresponds to that of the dielectric leaky-wave antenna of Patent Document 1. An antenna of the third comparative example was provided with a plurality of pairs of conductive strip elements placed on only a surface layer on a top side of a dielectric transmission substrate 1 at intervals of a adjacent distance "d" (=d0), instead of the conductive strip elements of the conductive strip groups 11, 12, 13, and 14 according to the implemental example of the present invention. Each pair of conductive strip elements were placed apart from each other by λg/4 along z-axis direction. The antenna of the third comparative example was further provided with a ground conductor formed on an entire bottom surface of the dielectric transmission substrate 1. Hence, the configuration of the antenna of the third comparative example corresponds to that of the dielectric leaky-wave antenna of Patent Document 2. However, the third comparative example failed to appropriately steer the maximum gain direction in a desired direction (+z direction). Accordingly, an antenna of the fourth comparative example was configured by removing the ground conductor on the bottom side of the dielectric transmission substrate 1 from the antenna of the third comparative example, and symmetrically placing the same structure as the pairs of conductive strip elements on the top side. As can be seen from the above description, although the antennas of the second to fourth comparative examples have conductive strip elements, these conductive strip elements do not serve as a multilayer loading structure. In each of the second to fourth comparative examples, the conductive strip elements were placed as much as possible, over a non-shielded region in the z-axis direction of the dielectric transmission substrate 1. Further, in each of the second to fourth comparative examples, the conductive strip elements had a width of d0/18 in the z-axis direction.

Figure 13:
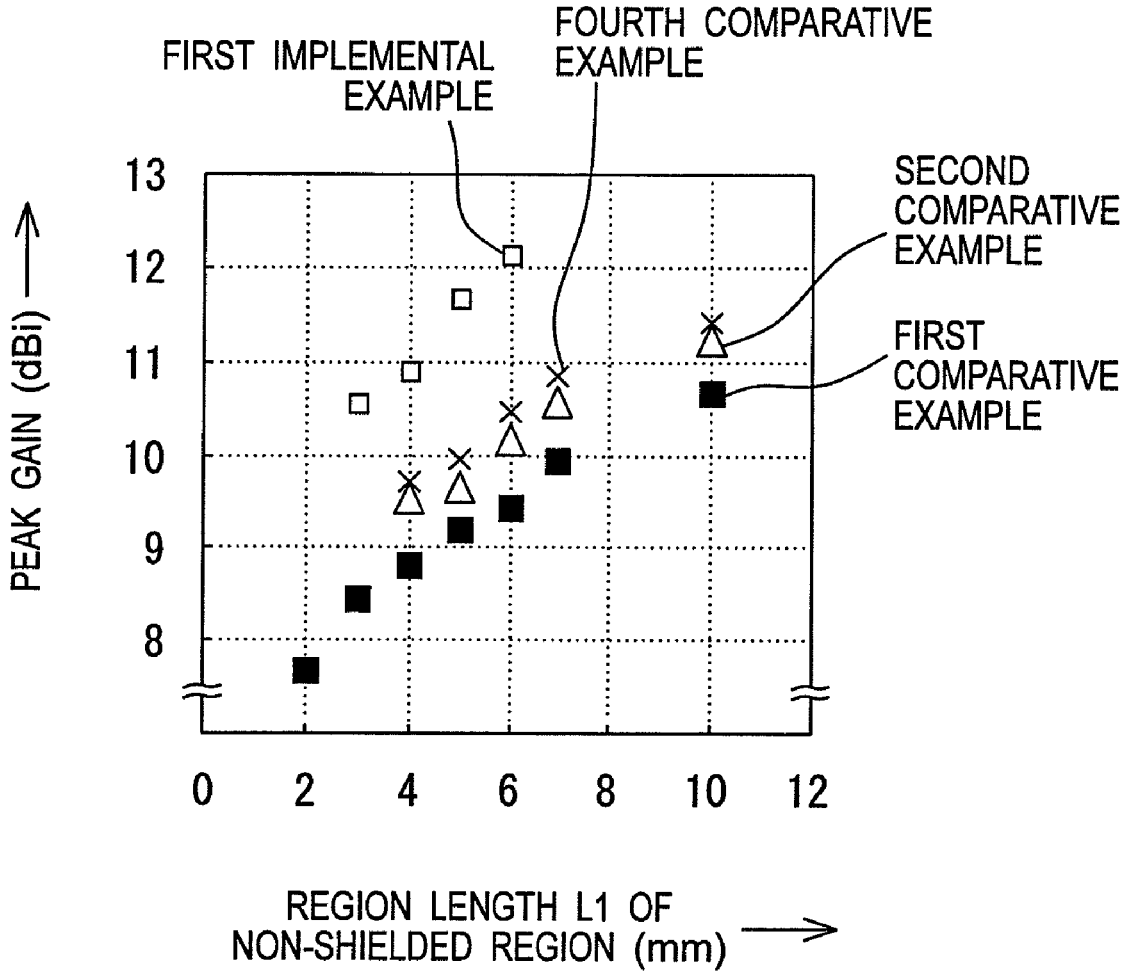
FIG. 13 is a graph showing characteristics of peak gains relative to a region length L1 of a non-shielded region, for an endfire antenna apparatus according to a first implemental example of the present invention, and for antennas of first, second, and fourth comparative examples.

FIG. 13 is a graph showing characteristics of peak gains relative to the region length L1 of the non-shielded region, for the endfire antenna apparatus according to the first implemental example of the present invention, and for the antennas of the first, second, and fourth comparative examples. Peak gains for a maximum gain direction were measured by changing the region length L1 of the non-shielded region of the dielectric transmission substrate 1 in a range of about 5 mm (=λ0), for the endfire antenna apparatus of the first implemental example of the present invention, and for the respective antennas of the first, second, and fourth comparative examples, when the antennas operated at an operating frequency of 60 GHz. Note that in the first implemental example of the present invention, the conductive strip elements of the respective conductive strip groups 11, 12, 13, and 14 were periodically placed at intervals of a distance d1=d2=d3=d4=d0/12. The first implemental example of the present invention achieved higher gains over the entire range where the region length L1 varied, as compared to those of all the first, second, and fourth comparative examples. For example, the fourth comparative example required a region length L1=10 mm to obtain a gain of 11.4 dBi, on the other hand, the first implemental example of the present invention could obtain an equal or higher gain even with a small antenna structure in which the length of the non-shielded region was halved to 5 mm. Further, at a fixed region length L1=5 mm (=λ0), the first implemental example of the present invention could achieve a gain higher than the fourth comparative example by 1.8 dB, higher than the second comparative example by 2.1 dB, and higher than the first comparative example by 2.5 dB. The gain obtained by the implemental example of the present invention and the gains obtained by the first to fourth comparative examples in case of the region length L1=5 mm are listed in the following Table 1.

TABLE 1

| | Gain (dBi) | Gain difference (dB) |
|---|---|---|
| First implemental example | 11.7 | |
| First comparative example | 9.2 | −2.5 |
| Second comparative example | 9.6 | −2.1 |
| Third comparative example | 8.2 | −3.5 |
| Fourth comparative example | 9.9 | −1.8 |

Second Implemental Example

Figure 14:
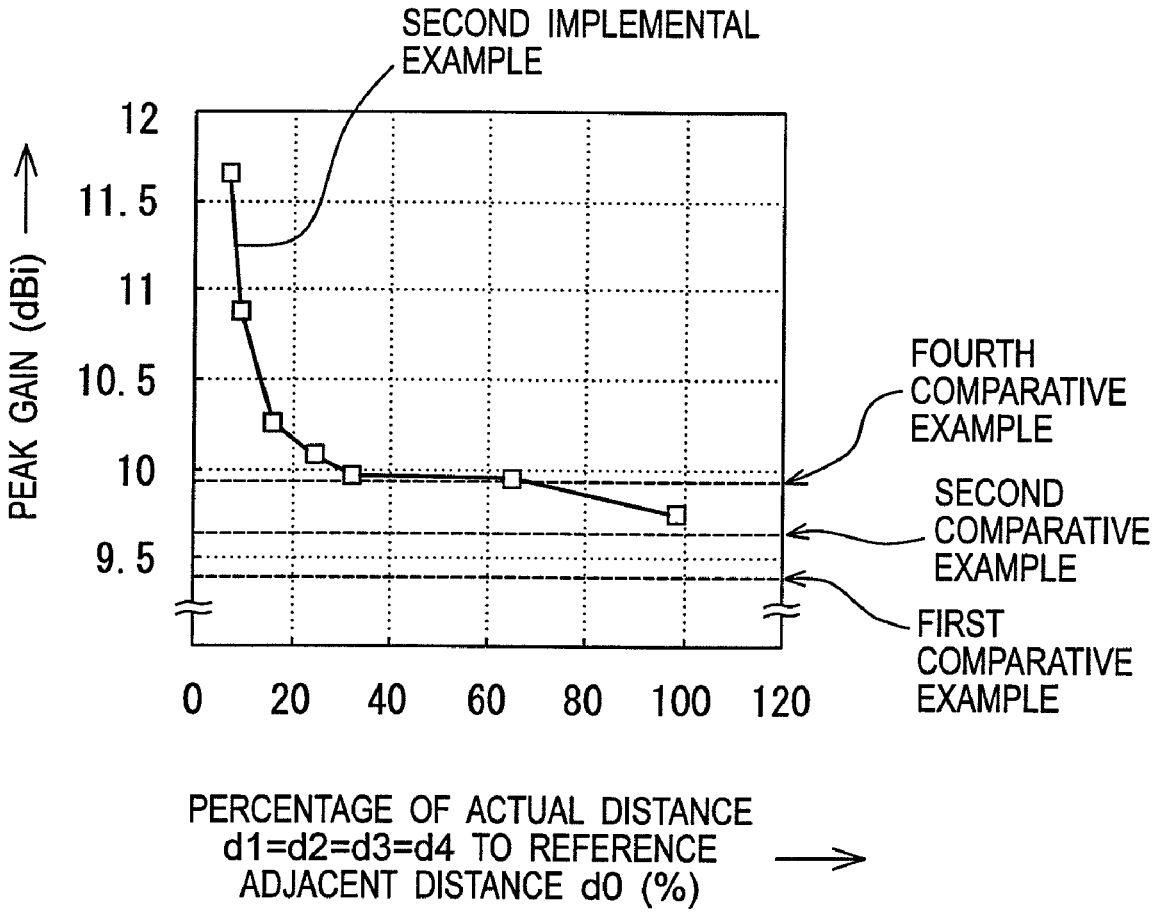
FIG. 14 is a graph showing characteristics of a peak gain relative to the percentage of actual distances d1=d2=d3=d4 to a reference adjacent distance "d0" for an endfire antenna apparatus according to a second implemental example of the present invention, and showing gain characteristics for the antennas of the first, second, and fourth comparative examples.

FIG. 14 is a graph showing characteristics of a peak gain relative to the percentage of actual distances d1=d2=d3=d4 to a reference adjacent distance "d0" for an endfire antenna apparatus according to a second implemental example of the present invention, and gain characteristics for the antennas of the first, second, and fourth comparative examples. In the second implemental example of the present invention, a region length L1 of a non-shielded region was fixed to 5 mm, and the distances d1=d2=d3=d4 for placing conductive strip elements were changed. On a horizontal axis in FIG. 14, the distances d1=d2=d3=d4 for placing the conductive strip elements are normalized by the reference adjacent distance "d0".

FIG. 14 also shows gain characteristics of the antennas of the first, second, and fourth comparative examples, for L1=5 mm. According to FIG. 14, the second implemental example of the present invention obtained the effect of significantly increasing gain, under the condition that the distances d1=d2=d3=d4 was 25% or less of the reference adjacent distance "d0" (e.g., 24.6711%). Further, a particularly desirable effect in increasing gain was obtained under the condition that the distances d1=d2=d3=d4 was less than 10% of the reference adjacent distance "d0", and in this case, the gain was higher than that of all the first, second, and fourth comparative examples by 1 dB or more.

Third Implemental Example

Figure 15:
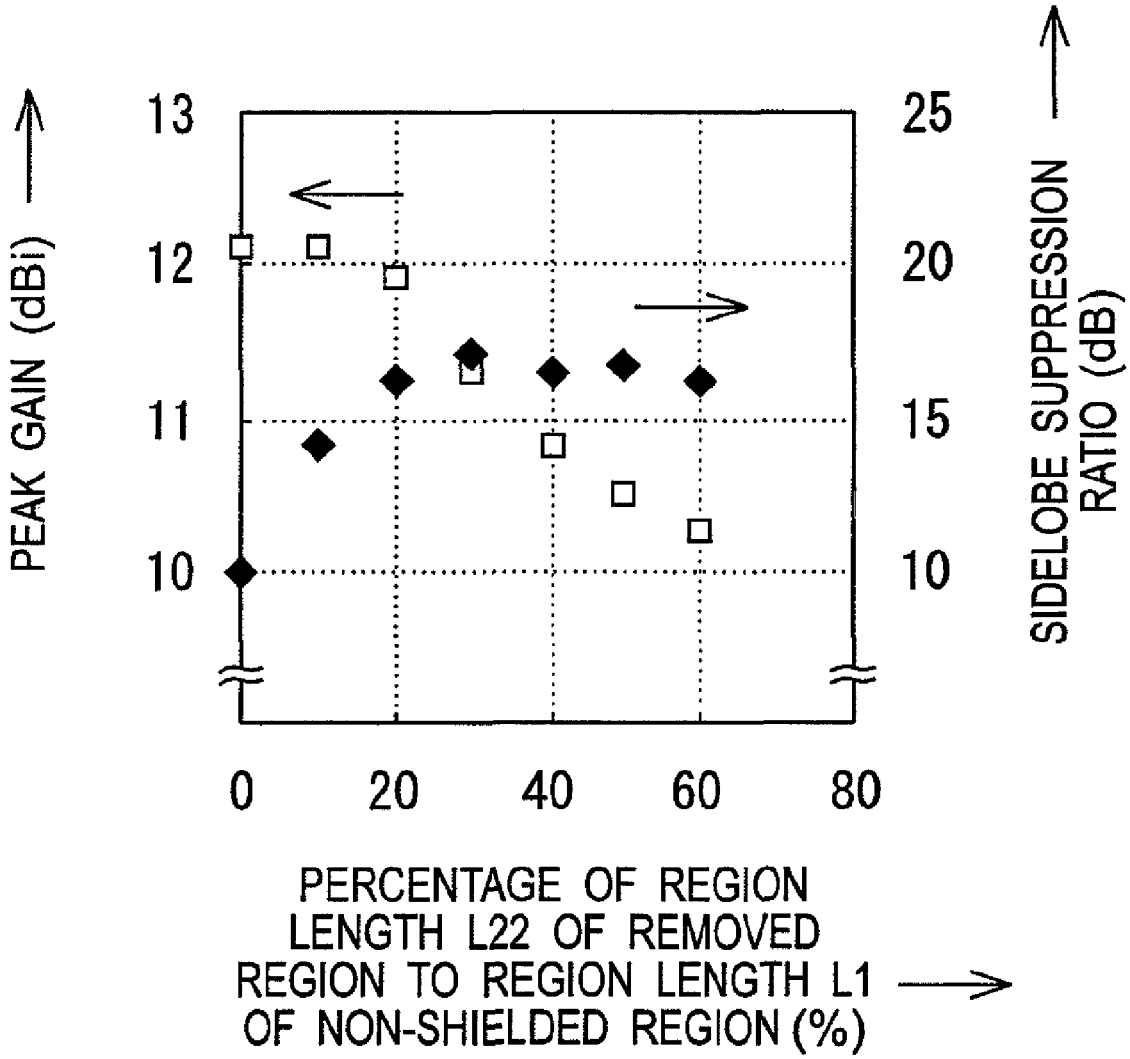
FIG. 15 is a graph showing characteristics of a peak gain and a sidelobe suppression ratio relative to the percentage of a region length L22 of removed regions 22 to a region length L1 of a non-shielded region, for an endfire antenna apparatus according to a third implemental example of the present invention.

FIG. 15 is a graph showing characteristics of a peak gain and a sidelobe suppression ratio relative to the percentage of a region length L22 of removed regions 22 to a region length L1 of a non-shielded region (i.e., a region-for-placement of multilayer loading structures 10A and 10B), for an endfire antenna apparatus according to a third implemental example of the present invention. The endfire antenna apparatus according to the third implemental example corresponds to the endfire antenna apparatus with the removed regions 22 according to the second preferred embodiment of the present invention shown in FIGS. 6 and 7. In this example, the region length L1 of the region-for-placement was fixed to 6 mm, Further, in the multilayer loading structures 10A and 10B on a top side and a bottom side of the dielectric transmission substrate 1, a region length L23 of second regions 23 close to an end face in +z direction of a dielectric transmission substrate 1 was fixed to 0.5 mm, and the region length L22 of the removed regions 22 was changed (with changing a region length L21 of first regions 21). In the third implemental example, other conditions were the same as those in the first implemental example. In FIG. 15, white plots indicate a peak gain characteristic, and black plots indicate a sidelobe suppression ratio relative to the main beam. According to the third implemental example, even when the region length L22 of the removed regions 22 occupied 20% of the region length L1 of the region-for-placement, the gain was reduced by only 0.2 dB as compared to the case without the removed regions 22. Meanwhile, the sidelobe suppression ratio was dramatically improved from 10 dB to 16.2 dB by setting the region length L22 of the removed regions 22 to 20% of the region length L1 of the region-for-placement. According to the fourth comparative example in FIG. 13, the gain in case of the region-for-placement with a region length L1=6 mm was 10.5 dBi. On the other hand, the gain obtained by the third implemental example of the present invention was equal to that of the fourth comparative example, under the condition that the region length L22 of the removed regions 22 occupied 50% of the region length L1 of the region-for-placement. Under this condition, a sidelobe suppression ratio of 16.7 dB obtained by the third implemental example was improved by 1.1 dB as compared to a sidelobe suppression ratio of 15.6 dB obtained by the fourth comparative example. When the region length L22 of the removed regions 22 was set to 10% of the region length L1 of the region-for-placement, the sidelobe suppression ratio was improved by 4.3 dB as compared to the case without the removed regions 22, while not causing degradation in gain. According to the these characteristics of the third implemental example, it is demonstrated to be possible to have advantageous effects according to the second preferred embodiment of the present invention, when the region length L22 of the removed regions 22 is set to 50% or less of the region length L1 of the region-for-placement, and more preferably between 10% and 20%.

As described above, as a result of comparison of characteristics between the implemental examples of the present invention and the comparative examples, it is demonstrated that the endfire antenna apparatus according to the preferred embodiments of the present invention has the effects of high gain, reduction in size, and suppression of sidelobes.

Since the endfire antenna apparatus according to the present invention can obtain high gain characteristics without increasing the area occupied by a circuit, it is expected to have effects that cannot be achieved by the conventional antennas, such as reduction in the area of an antenna unit, mounting on a small portable terminal, etc. For example, an endfire antenna apparatus can be mounted on remote controls of household electrical appliances such as Audio-Visual equipments. Particularly, in a millimeter-wave band where it is difficult to increase output powers of transmission systems and to reduce noises in reception systems, it is possible to have significant effects, such as reduction in power consumption, extension of a communication area, and increase in transmission capacity, etc. Further, since the endfire antenna apparatus can achieve high directivity while having a small size, the apparatus can be widely used not only for wireless transmission of data information but also for wireless transmission of power, thus having extremely high industrial applicability.

As described above, although the present invention is described in detail with reference to preferred embodiments, the present invention is not limited to such embodiments. It will be obvious to those skilled in the art that numerous modified preferred embodiments and altered preferred embodiments are possible within the technical scope of the present invention as defined in the following appended claims.

What is claimed is:

1. An endfire antenna apparatus comprising a dielectric transmission substrate, and a plurality of conductive strip elements placed along the width of the dielectric transmission substrate, wherein the length of the conductive strips are orthogonal to a transmission direction which is parallel to the length of the dielectric transmission substrate, the endfire antenna apparatus transmitting intra-substrate transmission components of an electromagnetic wave inside the dielectric transmission substrate along the transmission direction, transmitting surface transmission components of the electromagnetic wave along a surface of the dielectric transmission substrate along the transmission direction, and radiating a combined electromagnetic wave of the intra-substrate transmission components and the surface transmission components of the electromagnetic wave at an end of the dielectric transmission substrate, wherein the plurality of conductive strip elements compose a multilayer loading structure on at least one side of the dielectric transmission substrate, by which a part of the intra-substrate transmission components of the electromagnetic wave are leaked out of the surface of the dielectric transmission substrate, as the surface transmission components;

wherein the multilayer loading structure includes a first conductive strip group of conductive strip elements provided within a first plane, and a second conductive strip group of conductive strip elements provided within a second plane apart from the first plane by a predetermined distance; and the conductive strip elements of the first conductive strip group and the conductive strip elements of the second conductive strip group are formed to be capacitively coupled to each other;

wherein in each of the first and second conductive strip groups, at least a part of the conductive strip elements are placed at intervals of a distance of a quarter or less of a reference adjacent distance, the reference adjacent distance defined as a distance for generating spatial harmonics of the electromagnetic wave on the surface of the dielectric transmission substrate along the transmission direction; and wherein the endfire antenna apparatus includes two multilayer loading structures comprising: a first multilayer loading structure provided on a top side of the dielectric transmission substrate, and a second multilayer loading structure provided on a bottom side of the dielectric transmission substrate.

2. The endfire antenna apparatus as claimed in claim 1, wherein the reference adjacent distance is set to a length ranging from 0.46 to 2.23 times of a free-space wavelength of the electromagnetic wave.

3. The endfire antenna apparatus as claimed in claim 1, wherein the dielectric transmission substrate is a multilayer wiring substrate including a plurality of dielectric layers and a plurality of conductive layers, wherein the conductive strip elements of the first conductive strip group are formed in a conductive layer on the surface of the dielectric transmission substrate, and wherein the conductive strip elements of the second conductive strip group are formed in an inner conductive layer in the dielectric transmission substrate.

4. The endfire antenna apparatus as claimed in claim 1, wherein the conductive strip elements of the first conductive strip group and the conductive strip elements of the second conductive strip group are opposed to each other at least partial regions thereof.

5. The endfire antenna apparatus as claimed in claim 4, wherein any two adjacent conductive strip elements from the conductive strip elements of the first conductive strip group oppose to one of the conductive strip elements of the second conductive strip group, in partial region thereof.

6. The endfire antenna apparatus as claimed in claim 1, wherein the multilayer loading structure includes a removed region which is a continuous region without placing the conductive strip elements, in a part of a region for placement of the multilayer loading structure along the transmission direction, and a length of the removed region ranges to 50% or less of a length of the region for placement.

7. The endfire antenna apparatus as claimed in claim 6, wherein the length of the removed region ranges between 10% and 20% of the length of the region for placement.

8. The endfire antenna apparatus as claimed in claim 1, wherein the dielectric transmission substrate is supported by a further dielectric substrate with a lower permittivity than that of the dielectric transmission substrate such that at least one of a top surface and a bottom surface of the dielectric transmission substrate contacts with a surface of the further dielectric substrate.

* * * * *